US009791206B1

(12) United States Patent
Hall et al.

(10) Patent No.: US 9,791,206 B1
(45) **Date of Patent: *Oct. 17, 2017**

(54) MULTIPLE LINKED APPLIANCE WITH AUXILIARY OUTLET

(71) Applicant: INTIRION CORPORATION, Walpole, MA (US)

(72) Inventors: Gregory Allan Thomas Hall, Guelph (CA); Philip Emma, Topsfield, MA (US)

(73) Assignee: INTIRION CORPORATION, Walpole, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/135,873

(22) Filed: Apr. 22, 2016

Related U.S. Application Data

(63) Continuation-in-part of application No. 14/262,290, filed on Apr. 25, 2014, which is a continuation-in-part (Continued)

(51) Int. Cl.

| | |
|---|---|
| ***H05B 6/50*** | (2006.01) |
| ***H05B 6/64*** | (2006.01) |
| ***H05B 6/66*** | (2006.01) |
| ***F25D 23/12*** | (2006.01) |
| ***H05B 6/68*** | (2006.01) |

(52) U.S. Cl.
CPC ..... *F25D 23/12* (2013.01); *H05B 6/666* (2013.01); *H05B 6/68* (2013.01)

(58) Field of Classification Search
CPC . H05B 6/68; H05B 6/808; H05B 6/66; H05B 6/645; H05B 6/666; F25D 23/12; F25B 29/00
USPC ..... 219/482, 483, 485, 488, 678, 679, 695, 219/697, 702, 715, 716, 717, 718, 719, 219/720, 721, 722, 723, 756, 761, 707
See application file for complete search history.

(56) References Cited

U.S. PATENT DOCUMENTS 4,316,068 A * 2/1982 Tanabe ..... F24C 7/08 219/707
4,582,971 A * 4/1986 Ueda ..... H05B 6/6411 219/707

(Continued)

FOREIGN PATENT DOCUMENTS

JP 5-240447 A 9/1993
JP 2001-33043 A 2/2001

*Primary Examiner* — Hung D Nguyen
(74) *Attorney, Agent, or Firm* — Ralph E. Jocke; Walker & Jocke

(57) ABSTRACT

An apparatus includes microwave oven and refrigerator functions. The microwave oven is connected to a source of electrical power and has at least one control circuit for controlling the operation of the microwave oven. A first power supply outlet is provided on the microwave oven. A refrigerator is connected to the source of power by connection to the first power supply outlet. The at least one control circuit is configured to disable the refrigerator compressor, when the microwave oven demands cooking power, and enable the refrigerator compressor when the microwave oven is not drawing cooking power. A safety sensor is provided in the microwave oven and is configured to cause the microwave oven to cease cooking operation upon the safety sensor sensing a dangerous condition.

12 Claims, 24 Drawing Sheets

Related U.S. Application Data of application No. 12/317,632, filed on Dec. 23, 2008, now Pat. No. 8,742,304.

(60) Provisional application No. 61/009,419, filed on Dec. 28, 2007.

(56) References Cited

U.S. PATENT DOCUMENTS

| | | | | |
|---|---|---|---|---|
| 5,521,359 | A | 5/1996 | Bone | |
| 6,247,246 | B1 | 6/2001 | Scalese | |
| 2001/0052852 | A1 | 12/2001 | Kouznetsov | |
| 2003/0075538 | A1 | 4/2003 | Kish | |
| 2003/0106892 | A1 | 6/2003 | Shon | |
| 2004/0060932 | A1 | 4/2004 | Chun | |
| 2008/0000650 | A1 * | 1/2008 | Choi | A62C 3/006 219/679 |
| 2008/0236562 | A1 * | 10/2008 | Sager | F24C 7/08 126/273 R |

* cited by examiner

MULTIPLE LINKED APPLIANCE WITH AUXILIARY OUTLET

CROSS-REFERENCE TO RELATED APPLICATIONS

This application is a continuation-in-part of U.S. application Ser. No. 14/262,290, filed on Apr. 25, 2014, which is a continuation-in-part of U.S. application Ser. No. 12/317,632 filed on Dec. 23, 2008, which claims benefit under 35 U.S.C. §119(e) of Provisional Application No. 61/009,419, filed Dec. 28, 2007, the disclosures of which are incorporated herein by reference in its entirety.

TECHNICAL FIELD

Exemplary embodiments relate to improvements to appliances. Specifically, exemplary embodiments relate to improvements to appliances that include compact refrigerator and microwave oven functionality.

BACKGROUND

Compact refrigerators are used for many different purposes. They are often found in dormitories, hotels, offices and other establishments. Compact refrigerators are also often used in housing units for storage of beverages in bar areas or entertainment areas. Compact refrigerators provide useful storage for refrigerated items without the requirement for the considerable floor space and power draw that is required for a full size refrigerator.

Compact refrigerators and associated appliances may benefit from improvements.

SUMMARY

In one exemplary embodiment, an apparatus is provided that includes a microwave oven. The microwave oven includes a radiation emitting microwave element and a microwave housing. The microwave housing bounds a cooking interior area. The radiation emitting microwave element is operative to irradiate the cooking interior area. The apparatus also includes a refrigerator. The refrigerator includes a refrigerator housing. The refrigerator housing bounds a cooled refrigerator interior area. The refrigerator housing is in fixed operative connection with the microwave housing. The refrigerator includes a refrigerant compressor, or other refrigeration technology. The refrigerant compressor is operative to compress a refrigerant material. The refrigerant material is operative to cause cooling of the cooled refrigerator interior area. The apparatus includes at least one power control circuit. The at least one power control circuit is operative to cause electrical power to be selectively delivered to the microwave element and the compressor. One of the microwave element and compressor does not operate when the other of the microwave element and the compressor operates. The microwave oven further includes at least one sensor emitter and at least one sensor receiver configured to receive radiation from the at least one sensor emitter, wherein air of at least a portion of the cooking interior area extends intermediate of the at least one sensor emitter and the at least one sensor receiver. The apparatus also includes at least one safety circuit. The at least one safety circuit is in operative connection with the at least one sensor emitter, the at least one sensor receiver, and the microwave element. The at least one safety circuit is operative to cause the at least one sensor emitter to emit sensor radiation and the at least one sensor receiver to sense sensor radiation from the at least one sensor emitter while the microwave element operates during a cooking session. A determination is made that a transmission amount of sensor radiation from the at least one sensor emitter that reaches the at least one sensor receiver has fallen by at least a threshold amount during the cooking session, due to smoke in the cooking interior area. Responsive at least in part to the determination, the microwave element is no longer supplied with electrical power.

BRIEF DESCRIPTION OF THE DRAWINGS

The system of the application is explained in more detail below with reference to the accompanying drawing, in which.

DETAILED DESCRIPTION

Figure 1:
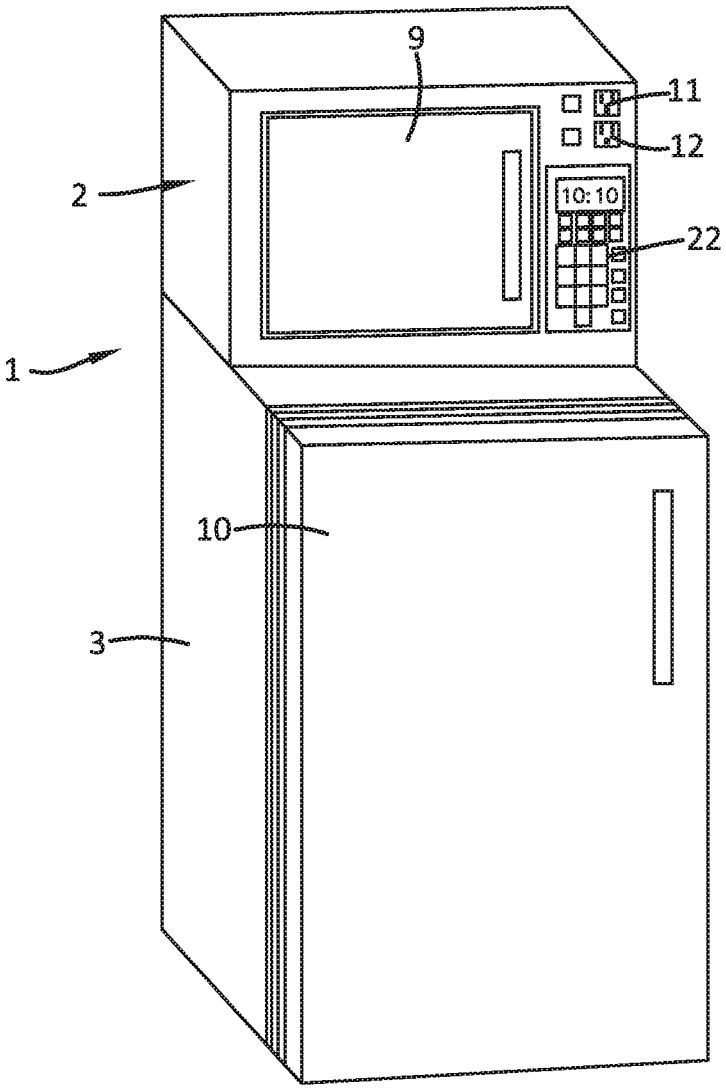
FIG. 1 is a front perspective view of an exemplary embodiment of an appliance system of this application.

A multiple linked appliance system 1, for example, a combination microwave oven 2 and refrigerator 3 incorporating features of the present application is illustrated in the Figures. Although the present application will be described with reference to the embodiments shown in the drawings, it should be understood that embodiments may have many alternate forms. In addition, any suitable size, shape or type of elements or materials could be used. The computer or controller devices described in this application may be constructed having one or several processors and one or several program product modules stored in one or several memory elements. For illustration, computer or controller components may be described as individual units by function. It should be understood, that in some instances, these functional components may be combined.

In the exemplary embodiments, the circuits described therein may comprise one or more circuits including data processors which for purposes hereof corresponds to any electronic device that is configured via circuit executable instructions that can be implemented in either hardware circuits, software, firmware or applications that are operative to enable the circuits to process data and carry out the other actions described herein. For example, the circuits may include circuits that correspond to one or more or a combination of a CPU, FPGA, ASIC or any other integrated circuit or other type or circuit that is capable of processing data. The processors may be included in a computer, server or other type of electronic device. Further, the circuits described herein may include data stores that correspond to one or more of volatile or non-volatile memories such as random access memory, flash memory, magnetic memory, optical memory, solid state memory or other devices that are operative to store computer executable instructions and data. Computer executable instructions, may include instructions in any of a plurality of programming languages and formats including, without limitation, routines, subroutines, programs, threads of execution, objects, methodologies and functions which carry out the actions such as those described herein. Structures for the circuits may include, correspond to and utilize the principles described in the textbook entitled Microprocessor Architecture, Programming, and Applications with the 8085 by Ramesh S. Gaonker (Prentiss Hall, 2002), which is incorporated herein by reference in its entirety. Of course it should be understood that these circuit structures are exemplary and in other embodiments, other circuit structures for storing, processing, resolving and outputting information may be used.

In exemplary embodiments the refrigerator may be connected to a power supply that provides a connection for the microwave oven to be connected to the same supply. A single plug, therefore, may serve to connect both appliances and the current required for each appliance is supplied by the same supply cord and circuit. In exemplary embodiments power may be supplied by a 110V AC current outlet.

To make this combination attractive for use in dorm rooms, hotel rooms, recreational vehicles, tractor trailer cabs, and other similar locations, it may be necessary to provide some way by which the peak currents of both appliances are not demanded from the supply at the same time. Many household circuits are protected from overload conditions by an automatic circuit breaker that is activated when current in the circuit exceeds the breaker rating. This is 15 amps in many circuits.

The duty cycle of a refrigerator used in these combined systems includes a current spike that occurs during the first few seconds of operation. This is the start up current for the refrigerator compressor and is considerably reduced as the compressor attains its operational speed. In typical refrigerator appliances the peak current may be in the range of 7 to 9 amps, while the steady state current may level off at 1.4 amps or less. A microwave oven demands a relatively steady 8 to 13 amps of cooking power during operation of the cooking element. It is apparent that an overload condition will occur frequently, when both appliances are in use, unless some control is exercised.

In an exemplary embodiment, a combination microwave and refrigerator system is constructed having a single plug input supply. The microwave oven is adapted to provide power to a refrigerator through a power supply outlet, and to auxiliary receptacles adapted for connection to devices that operate at a low power draw. The microwave oven includes a microprocessor power control circuit or controller adapted to monitor operation of the refrigerator compressor and controls the power to the microwave magnetron cooking element and other components. The current draws on the low power receptacles are separately monitored for control by the microwave controller. The microwave controller is adapted to balance the duty cycles of the connected appliances attached to avoid overload conditions. A control logic flow is implemented internally within the microwave controller. A receptacle or other power connecting power supply outlet for the refrigerator and the low power auxiliary receptacle may be implemented as part of the microwave control panel.

In one embodiment, the auxiliary outlets are constructed to provide low power for the purpose of recharging cellular mobile phones, personal media devices and digital cameras, in addition to operating lap top computers and other low power devices. The current to the auxiliary outlets is sensed and provided to the microwave controller.

In another embodiment, the power to the auxiliary outlets is disabled by the microwave controller when the microwave magnetron is energized or whenever the current to the auxiliary outlets exceeds a preset value.

In one embodiment, a control model or logic flow is established and executed by the microwave controller. The model is dependent on the state of operation of the microwave magnetron. As part of the control model, the power being drawn to the compressor is monitored to sense operation of the compressor to compress refrigerant to provide cooling. When cooking power is demanded by the microwave the compressor is disabled by having electrical power thereto withdrawn by the control circuit for a preset minimum period. When microwave demand ceases, refrigerator compressor power is restored provided that the preset minimum period has expired.

In another embodiment of the control model, sensing circuits are connected to monitor current drawn to the auxiliary outlets. The control model is adapted to disable the power to the auxiliary receptacles, if the microwave commences cooking operation. In addition the auxiliary receptacles are disabled if a predetermined maximum current draw is sensed. Another control model is based on operation of the refrigerator and operates to disable the auxiliary receptacles when the compressor is in an operation condition, such as for example in the start up mode.

In one aspect of an exemplary embodiment, a non-transitory processor storage readable medium having processor executable program instructions embodied therein for operating at least one processor of a control circuit to control a system of multiple linked appliances having a microwave oven, a refrigerator, and an auxiliary power supply outlet is provided. The processor executable program code causes the control circuit to disable the refrigerator and the auxiliary power supply outlet, when the microwave demands power, and enable the auxiliary power supply outlet when the microwave is not drawing cooking power.

Figure 2:
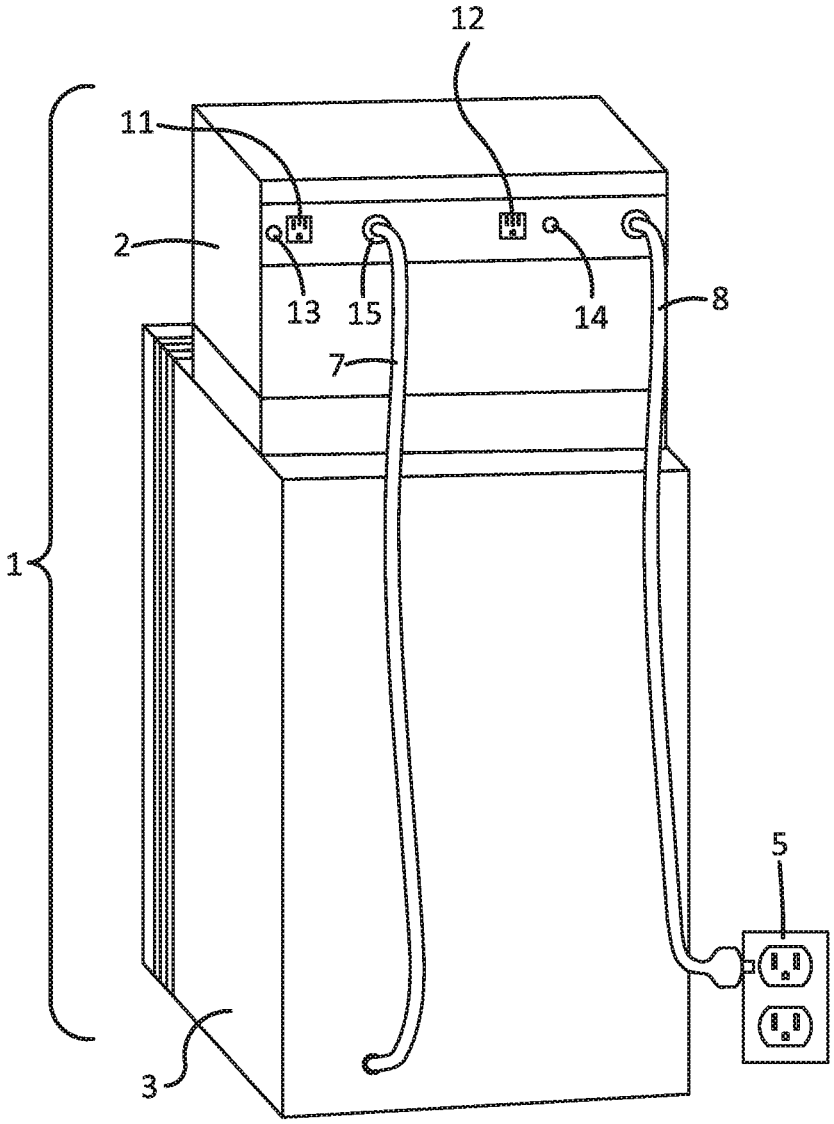
FIG. 2 is a rear perspective view of the embodiment of FIG. 1 showing an alternative arrangement.

One embodiment of a multi-appliance interconnected system 1 is illustrated in FIG. 1. This embodiment consists of two appliances, a refrigerator 3 and a microwave oven 2. Refrigerator 3 is electrically connected to microwave oven 2 by power cord 7 to refrigerator receptacle 15, shown at the rear of the microwave 2 in FIG. 2. Refrigerator 3 is generally subject to control by the microwave microprocessor controller which is alternatively referred to as power control circuit 4 of the microwave oven 2. The power control circuit may be operative to cause electrical power to be selectively delivered to the microwave magnetron and the refrigerator compressor. A single cord 8 provides input electrical power to the system 1 from receptacle 5 through microwave 2. In the case where stand alone appliances are used, as shown in FIGS. 1 and 2, microwave oven 2 is connected directly to power source 5. The refrigerator 3, as the heaviest component, is used as the base with the microwave oven 2 stacked on top. In the selection of the refrigerator 3, it would be advantageous in one embodiment for the height of the refrigerator to be no more than 48 inches above the floor. This provides a more ergonomic operation of the microwave oven 2 for the user. In addition, in the stacked position of the appliances in an exemplary embodiment, the doors 9 and 10 of the microwave 2 and refrigerator 3, respectively, are arranged in a common plane.

Figure 3:
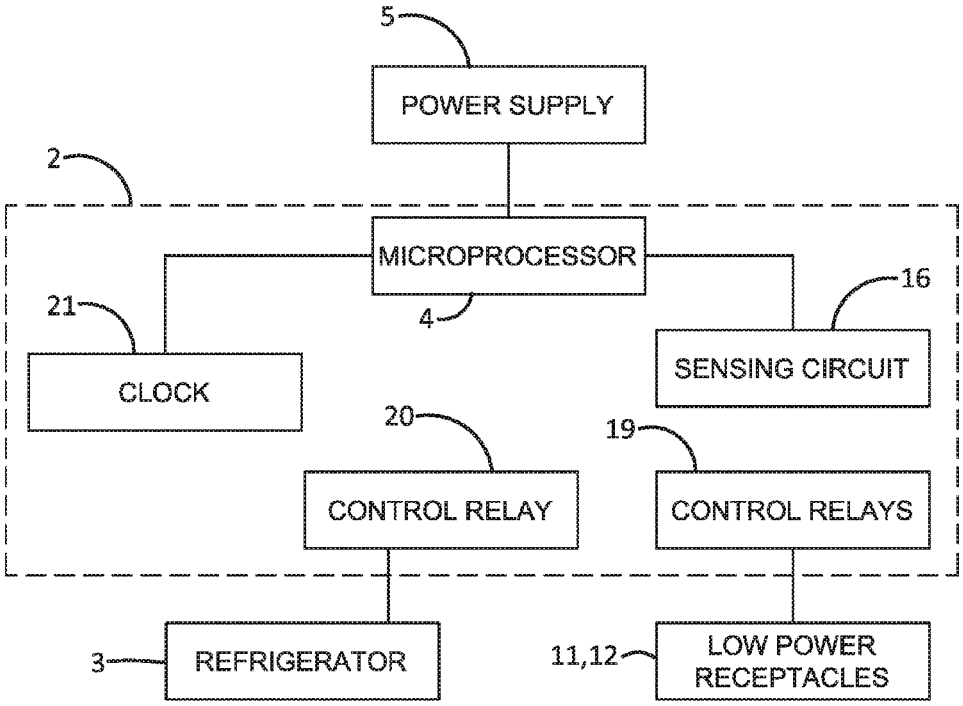
FIG. 3 is a block diagram of an embodiment of the system.
Figure 8:
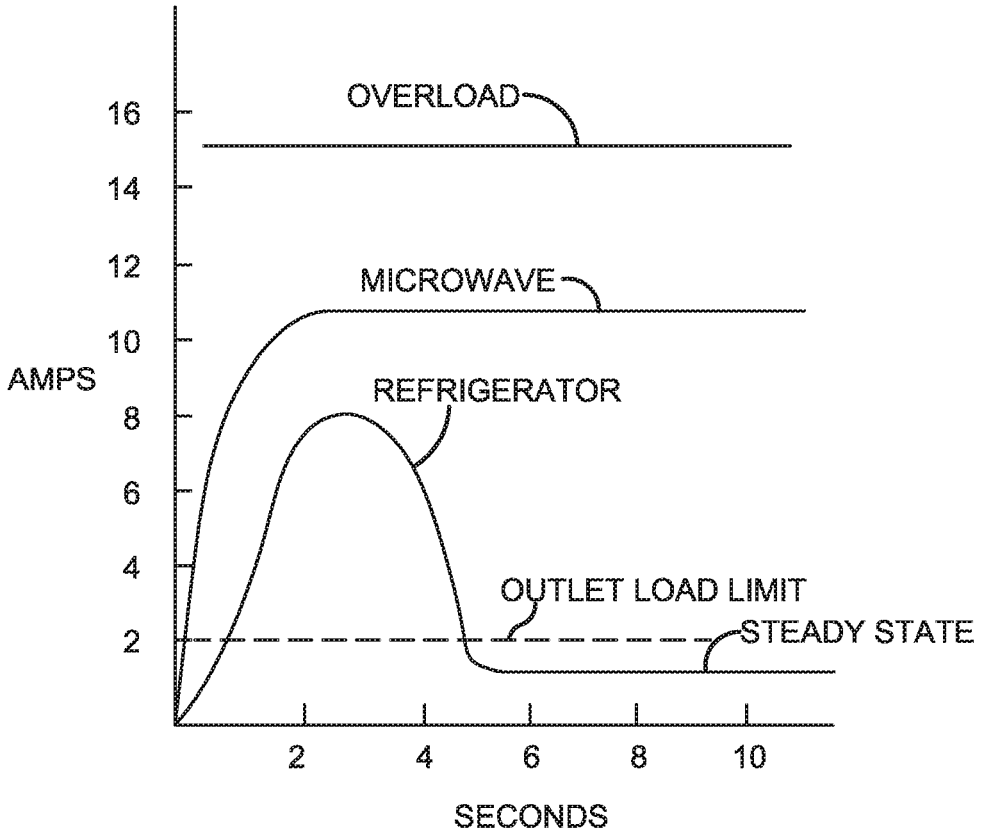
FIG. 8 is a graph illustrating the duty cycles of the appliances in the system of FIG. 3.

At least one power control circuit 4 serves as a controller for the operation of the microwave oven 2 and is also adapted to control the other components of system 1, as shown in FIG. 3. Power is distributed throughout the system 1 under control of microwave controller 4 and digitally operated switches such as relays 19 and 20 of FIG. 3. Power is distributed to each of the appliances 2 and 3, and to auxiliary low power receptacles 11 and 12. In use lamps 13 and 14 in the form of LEDs or the like may be connected to the auxiliary receptacles to indicate power being available or disabled. The low power auxiliary receptacles 11 and 12 are provided to permit convenient access for plugging in a low power device, for example, rechargeable devices, such as cellular phones, PDAs, or other electronic devices that do not demand high power. As shown in the graph of FIG. 8, there are instances during which, if more than one of the appliances is in use, the cumulative current would cause an overload condition.

Control panel 22 of microwave oven 2 may be adapted to provide a display of the particular status of the controlling relays. For example, LEDs 13 and 14 may indicate that power to the outlets 11, and 12 are disabled or available. In one embodiment the lamps will light when power is available at the outlet and flash when disabled. In another embodiment the lamps will light when power is disabled at the outlet and not activate when power is available at the outlet as a means to reduce the Standby Power requirements. A button operated touch panel provides manual control.

Figure 4:
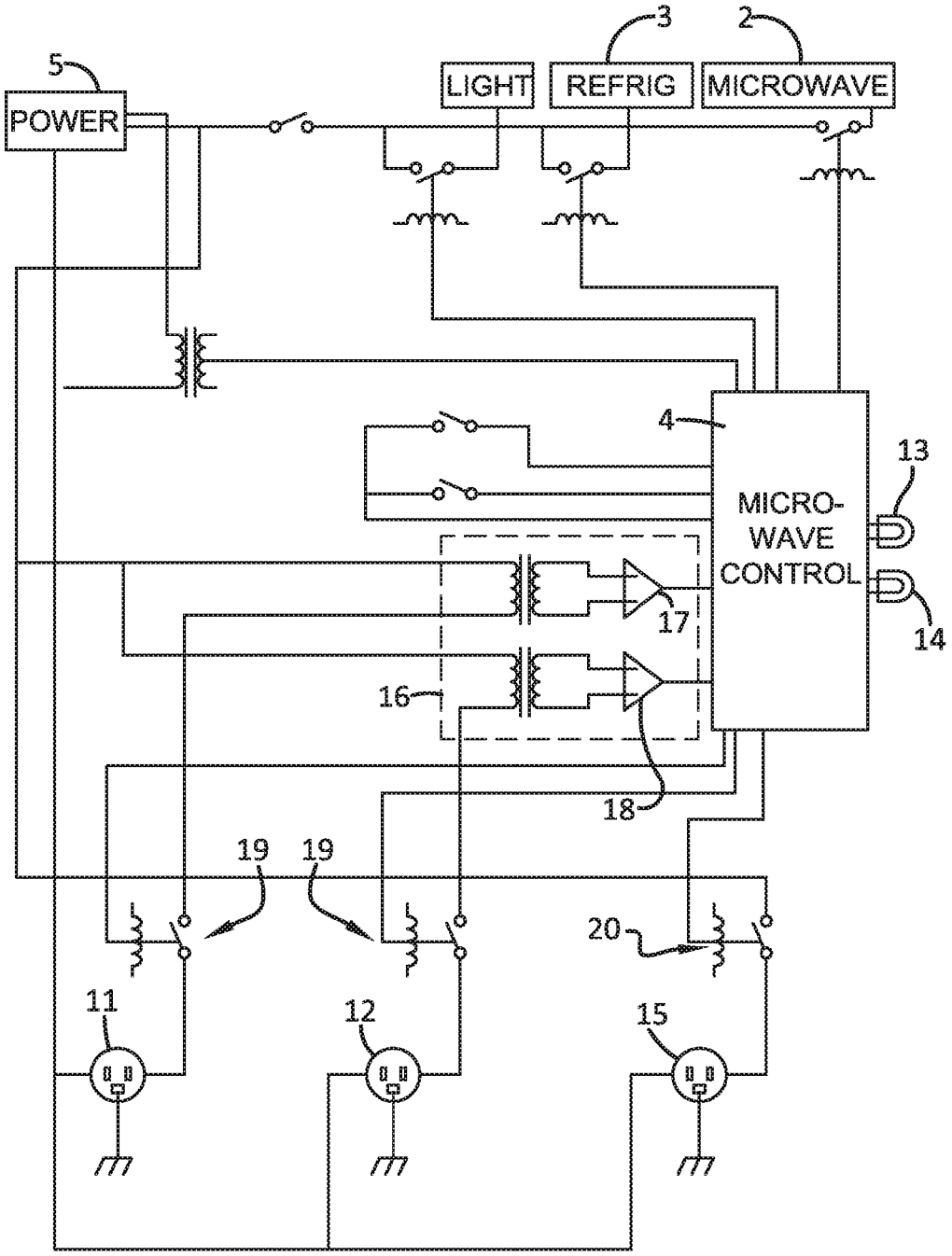
FIG. 4 is a schematic diagram of the embodiment of FIG. 3.

As shown in FIG. 4, in order to control the power to the microwave 2, refrigerator 3 and receptacles 11 and 12, sensing circuits, may be coupled to the control circuit to monitor current to the appliances and the auxiliary receptacles. A relay 20 is connected in the power line to the refrigerator and may be actuated by signals from controller 4. In particular, according to an exemplary embodiment, sensing circuits 16, as shown in FIG. 4, have sensors 17 and 18 coupled to the power line of the auxiliary outlets 11 and 12 to monitor the current being used by a connected device. Sensors 17 and 18 may include current sensing transformers of the type available from Triad Magnetics of Corona, Calif. The signals generated by sensors 17 and 18 may be used to activate switches or other control components, such as relays 19. Relays 19 may be actuated by control circuit 4 to enable and disable power to the low power auxiliary outlets 11 and 12 in response to signals from sensors 17 and 18. A maximum current may be set by the power control circuit 4 to prevent overload of the outlets 11 and 12. In one embodiment of the system of this application, the maximum current limit is set at 2 amps.

In another embodiment, a clock function 21 included in the at least one control circuit 4 is used to provide timed delays during which, for example, refrigerator 3 would be prevented from undesirably rapid on/off cycles. When the compressor of the refrigerator 3 is disabled during microwave cooking operation, a time delay of 3 minutes is provided during which refrigerator 3 will remain disabled, even if microwave use is only for a short period. Control circuit 4 may be programmed to manage the power to the components of the system to avoid overload conditions, while minimizing disruptions in the use of an individual appliance. A model of operative events and related control operations may be designed into the program instructions executed by at least one control circuit 4 to provide a control methodology as illustrated in FIGS. 5-7.

In one embodiment, as illustrated in the block diagram of FIG. 3, at least one control circuit 4, constructed as part of the controller for microwave 2, is adapted to process the sensor signals and identify particular events in the system 1 related to a particular appliance. Circuit 4 controls the power to microwave 2 and refrigerator 3 and also low power receptacles 11 and 12 to avoid overload conditions. The circuit 4 could be programmed to execute the control methods illustrated and described below. In one embodiment, the circuit 4 includes a control microprocessor for microwave oven 2 and is adapted to execute the program instructions described below. Control circuit is coupled directly to refrigerator outlet 15 and low power outlets 11 and 12.

In one embodiment, shown in FIG. 1, the outlets 11, and 12, are installed as part of the front control panel of microwave oven 2. In FIG. 2, in another embodiment, the auxiliary receptacles 11 and 12 and refrigerator receptacle 15 are accessible at the rear of the microwave oven 2. In these alternative embodiments, the microwave oven 2 is connected by supply cord 8 directly to power supply receptacle 5. Refrigerator 3 is connected by power cord 7 to receptacle 15 in microwave oven 2 as shown in FIG. 2.

Figure 5:
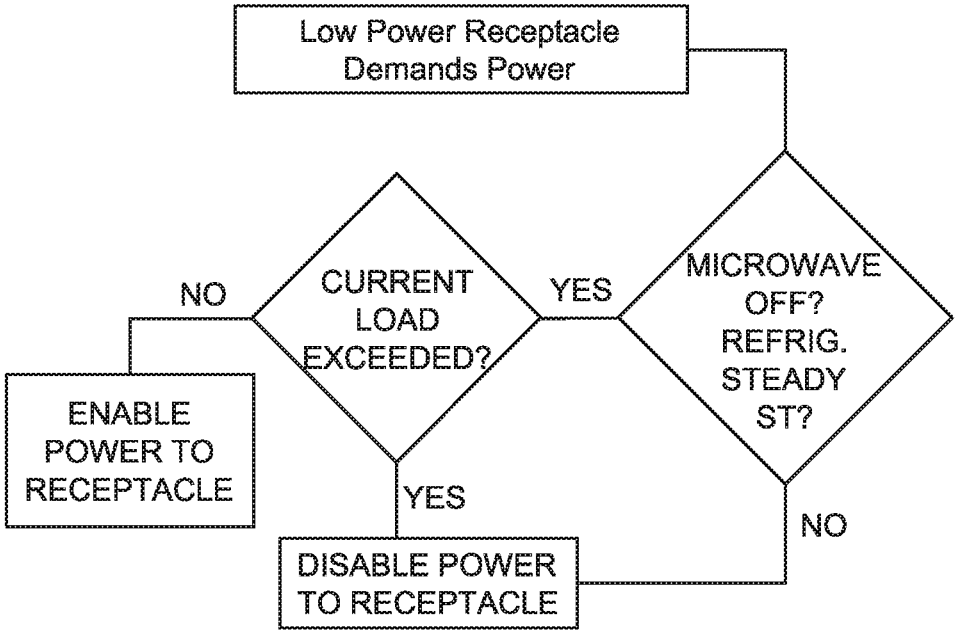
FIG. 5 is a logic flow diagram of an embodiment.
Figure 6:
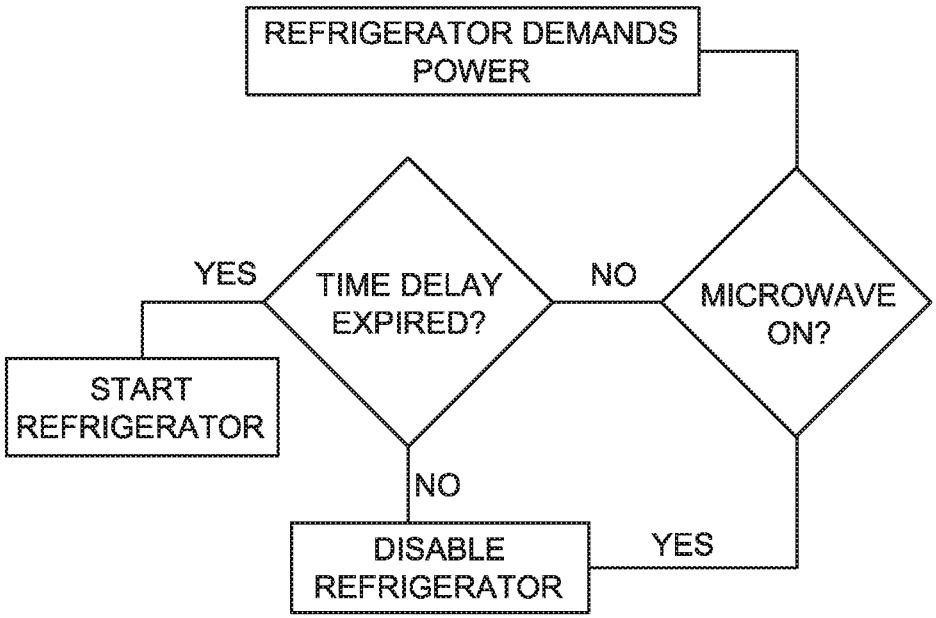
FIG. 6 is a logic flow diagram of another embodiment.
Figure 7:
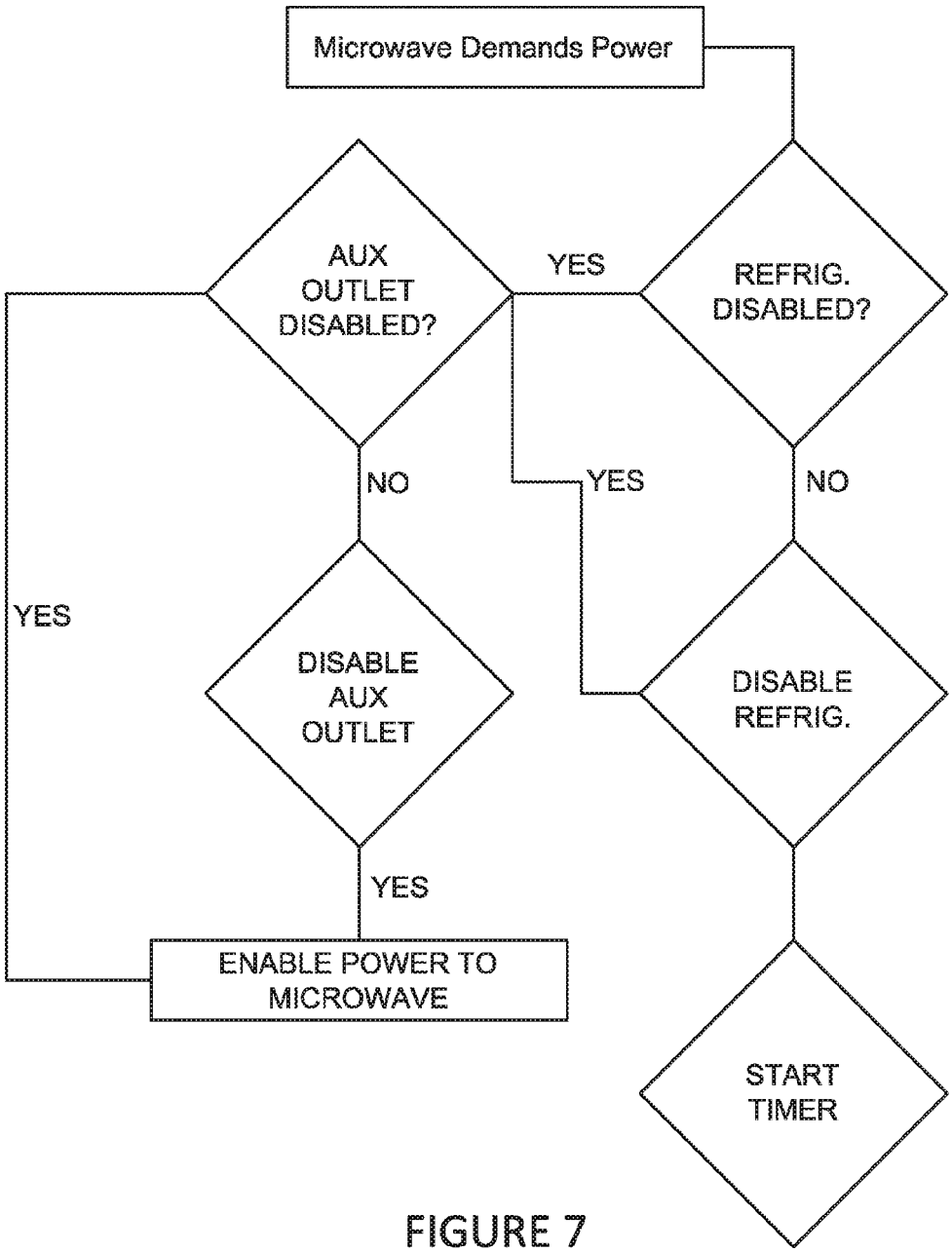
FIG. 7 is a logic flow diagram of another embodiment.

In one embodiment, control models comprising logic flows are established as shown in FIGS. 5-7 for execution by the at least one control circuit 4. These models can be in the form of processor executable instructions stored in a computer readable medium, such as software or firmware within the circuit 4. The models shown are, in the first instance, dependent on the state of operation of microwave oven 2. The current demands of the microwave 2 when drawing cooking power are generally the most significant contribution to overload, as shown in FIG. 8. To avoid overload conditions, power to the low power receptacles 11 and 12 and refrigerator receptacle 15 is disabled during microwave operation. If the refrigerator 3 compressor is drawing power when the microwave 2 is turned on to commence cooking, the power to the refrigerator compressor is turned off and clock function 21 is used to determine a predetermined period during which the compressor of refrigerator 3 cannot be restarted. A time delay, for example, of 3 minutes, may be set through programming of the control circuit and when this delay period is expired, receptacle 15 may again be enabled, provided microwave cooking operation has ceased. This prevents a too rapid restart of the compressor that may otherwise result in damage.

In the embodiment shown in FIG. 5, if low power is demanded at receptacle 11 or 12 and microwave oven 2 is not in use for cooking, power is supplied to the low power receptacles, provided further, that the current demand at an individual outlet does not exceed a preset limit, for example, 2 amps. Since the auxiliary outlets may be enabled during refrigerator compressor operation, there may be an overload generated at peak compressor operation. In one embodiment the control circuitry acts to disable the auxiliary outlets during compressor startup to prevent accidental overload of the system. Therefore as illustrated in the logic flow diagram of FIG. 5, control circuitry may be adapted to check the operational status of the refrigerator, as well as the microwave oven, prior to enabling the auxiliary outlets.

Figure 9:
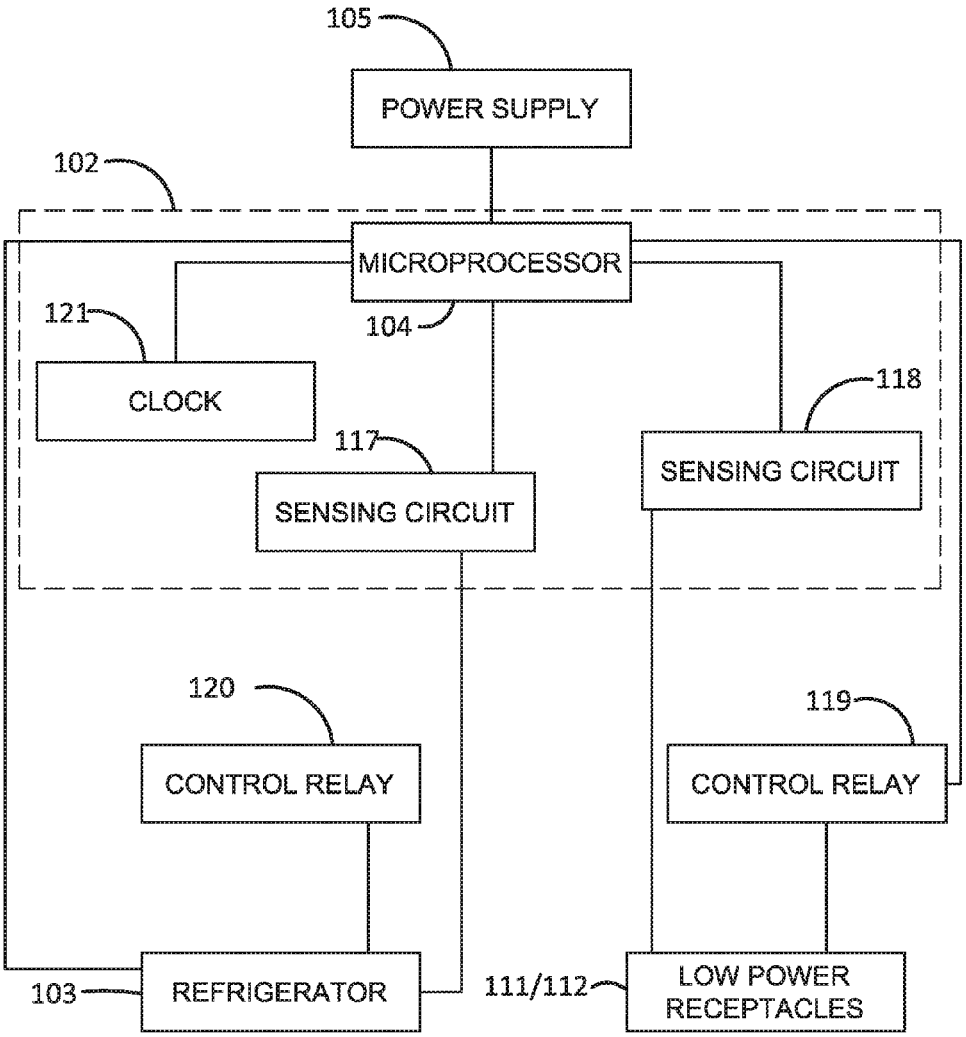
FIG. 9 is a block diagram of an alternate embodiment.
Figure 10:
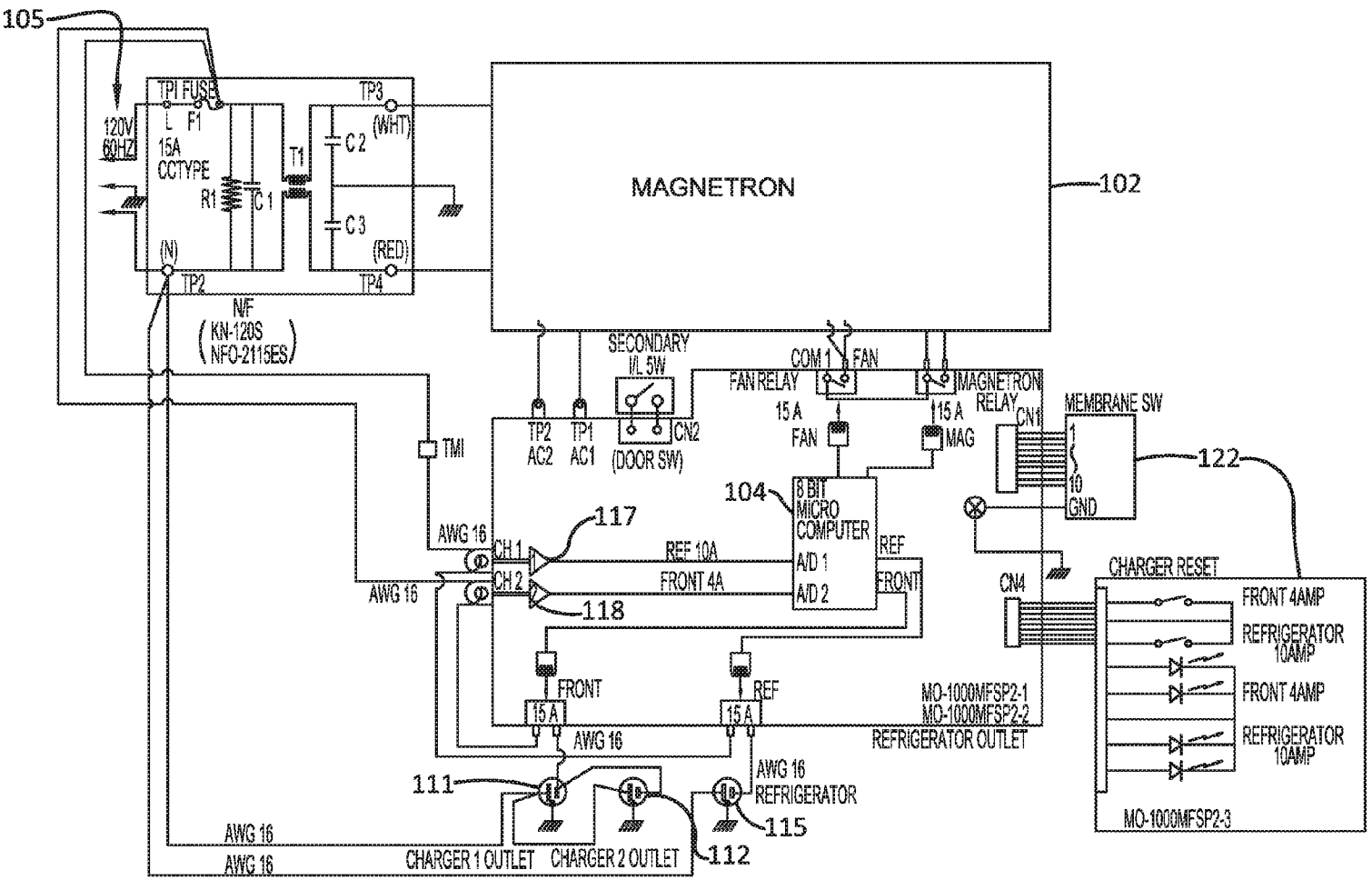
FIG. 10 is a schematic diagram of the embodiment of FIG. 9.
Figure 11:
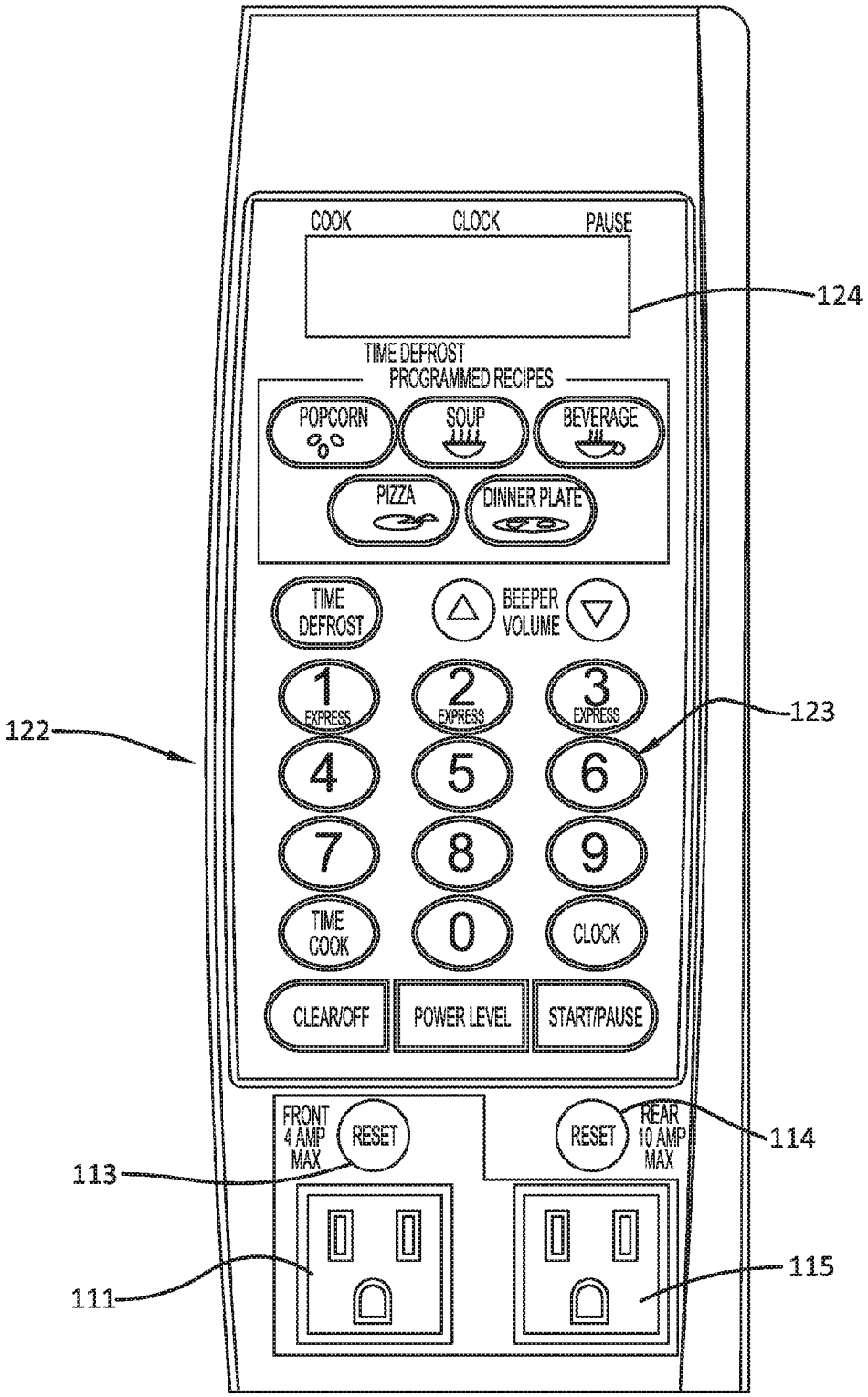
FIG. 11 is an illustration of a control panel of the embodiment of FIG. 9.

FIGS. 9-11 illustrate another embodiment. In this embodiment the sensing components 117 and 118 are connected to reduce the risk of overload by the combined demands of the auxiliary outlets 111 and 112 and the refrigerator outlet 115. In the configuration as shown in FIG. 10, current sensor 117 is connected to monitor the current draw through the refrigerator outlet 115 and is configured to limit the refrigerator current component so that it does not exceed 10 amps. Current sensor 118 is connected to monitor the combined current in the auxiliary outlets 111 and 112. Current sensor 118 is constructed to limit the combined auxiliary outlet current to 4 amps. In this manner the risk of overload is minimized. In the block diagram of FIG. 9, the microwave 102 having at least one control circuit comprising controller 104 is connected to power supply 105. Clock function 121 of the controller provides a timing device to determine a restart delay for refrigerator 103. Sensing circuit/sensor 117 is connected to monitor the current demanded by refrigerator 103 and sensing circuit/sensor 118 is connected to low power receptacles 111 and 112 to monitor the combined current draw of receptacles 111 and 112.

In this embodiment, as shown in FIG. 11, a control panel 122 is arranged with a keypad 123 for manual control and a display 124. Auxiliary outlet 111 is shown as accessible from the front and is associated with a status LED indicator and reset button 113 that may be caused to be on during use and switch to a flashing mode when the microwave is drawing cooking power. Refrigerator outlet 115 is also shown to be accessible from the front panel and is associated with an LED indicator and reset button 114. Similarly LED indicator 114 is controlled to be on during use of the refrigerator and to switch to a flashing mode when the microwave is drawing cooking power. In another embodiment, the status LED indicator and reset button 113 may be caused to be off during use and switched on or to a flashing mode when the microwave is drawing cooking power. Similarly, in this embodiment, the LED indicator 114 is controlled to be off during operation of the refrigerator compressor and switched on or to a flashing mode when the microwave radiation cooking element is operating.

A further embodiment of the processor operational model is shown in FIG. 6. In this model, the refrigerator compressor draws or demands power. This may be triggered by a temperature rise of the refrigerator interior area within the housing of the refrigerator and involve start up of the refrigerator compressor with an associated peak power demand. If the microwave is currently drawing cooking power, the cycling of the refrigerator compressor will be delayed. If the microwave cooking element was on and subsequently cycled off, the clock function 21 is used to determine if the restart can occur. Under some circumstances, it may be necessary to give the refrigerator compressor priority to prevent an undesirable rise in temperature. In the latter instance, the control circuit can be coupled to the refrigerator temperature sensor to execute a time sequence during which the microwave cooking element will be disabled by not having power supplied thereto to allow the refrigerator to return to proper operating temperatures.

In the embodiment of FIG. 7, priority is given to the power demands of the microwave oven, as indicated above. Use of the receptacles 11, 12, and 15 are, therefore, disabled during microwave cooking operation. The operational models, illustrated in FIGS. 5-7, may be established by logic flows implemented by instructions that are programmed or imbedded in controller 4.

In this manner a system of linked appliances, including a microwave oven, refrigerator, and at least one low power appliance may all be connected through a common supply cord to a receptacle providing house current or other electrical power level without the risk of inconvenient interruptions during use caused by overloads.

It is also advantageous to provide such a combination microwave/refrigerator system that also provides auxiliary outlets for low power applications, such as for the purpose of recharging cellular phones, operating lap top computers and other low power devices, while controlling the operation of the appliances to avoid overload conditions.

Figure 13:
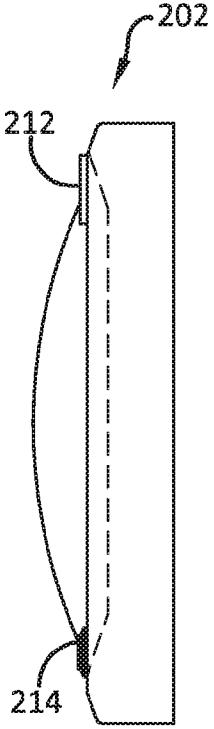
FIG. 13 is a side view of the microwave oven door of FIG. 12.
Figure 12:
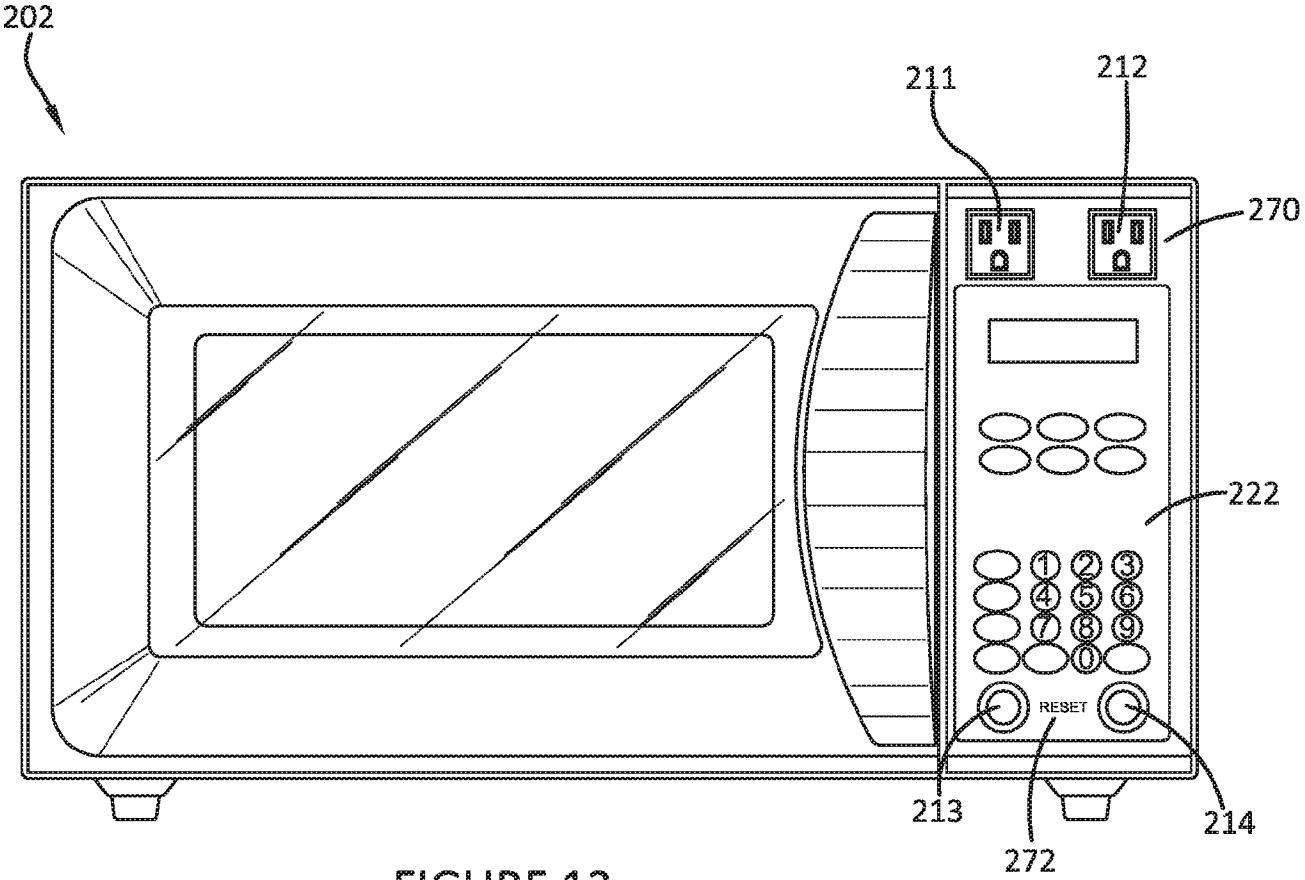
FIG. 12 is a front view of the microwave oven according to another embodiment.

In another exemplary embodiment as illustrated in FIGS. 12 and 13, the auxiliary outlets or receptacles 211, 212 may be included as part of the front control panel 222 of the microwave oven 202 and located on the upper portion 270 of the front control panel 222. The auxiliary outlets 211, 212, front control panel 222 and microwave oven 202 are similar to auxiliary outlets 11, 12, front control panel 22, and microwave oven 2 except for that discussed below. In this exemplary embodiment, the auxiliary outlets 211, 212 are positioned side by side with respect to each other with each of the auxiliary outlets 211, 212 being at the same height as the other. The auxiliary outlet 211 of FIG. 12 may be associated with a status LED indicator and reset button 213, which is located on the lower portion 272 of the front control panel and in vertical alignment with the auxiliary outlet 211. The status LED indicator and reset button 213 may be caused to be on during use and switched to a flashing mode when the microwave oven 202 is drawing cooking power. The auxiliary outlet 212 of FIG. 12 may be associated with status LED and reset button 214, which is located on the lower portion of the front control panel and in vertical alignment with the auxiliary outlet 212. The status LED indicator and reset button 214 may be caused to be on during use and switched to a flashing mode when the microwave oven 202 is drawing cooking power. In another embodiment, the status LED indicator and reset button 213 may be caused to be off during use and switched on or to a flashing mode when the microwave oven is running. Similarly, in this embodiment, the status LED indicator and reset button 214 may be caused to be off during use and switched on or to a flashing mode when the microwave oven is cooking. All other elements are similar in structure and function as that of the embodiments shown in FIGS. 1-11. Thus, the same reference numbers will be used in this exemplary embodiment to indicate elements that are similar in the embodiments shown in FIGS. 1-11.

Figure 14:
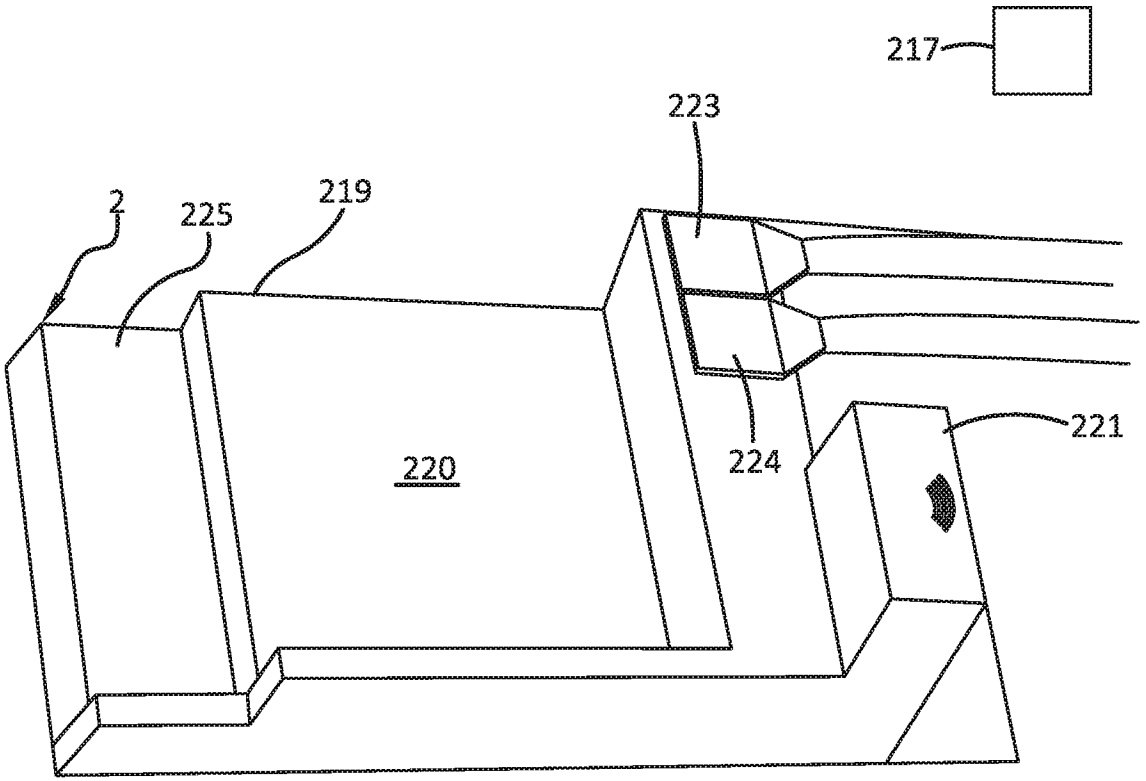
FIG. 14 is a top perspective view of a charging pad on the top portion of a microwave oven.

Smart technology may be included in each of the exemplary embodiments. For example, a user may be able to regulate the refrigerator 3 such as by turning it on and off remotely by a remote control 217. The remote control 217 may include a hand held device such as a cellular phone. The cell phone may also be a smart phone. A charging pad 219 (FIG. 14) may be provided on the microwave oven 2 or other suitable place to receive the smart phone for charging the smart phone. For example, a wireless charging pad 219 may be positioned on top 225 of the microwave oven 2 for recharging the smart phone. The charging pad 219 may be built into the top 225 of the microwave oven 2 or be a separate piece that is mounted to the top 225 of the microwave oven 2. The exemplary charging pad 219 is an inductive charging pad and includes a recessed area 220 for receiving an item to be charged such as the smart phone. The control circuitry may include or be in operative connection with a wireless interface 221 configured for communicating with for the remote control 217 for controlling the microwave or refrigerator and work in conjunction with the control circuitry to perform functions such as removing the supply of electrical power to the microwave oven 2 and/or refrigerator 3. USB ports 223, 224 may be provided in the area of the charging pad 219. Alternatively, or in addition, power outlets may be provided in proximity to the charging pad 219. Alternatively, the charging pad 219 may be provided on the front, side, rear or bottom of the microwave oven 2.

Figure 16:
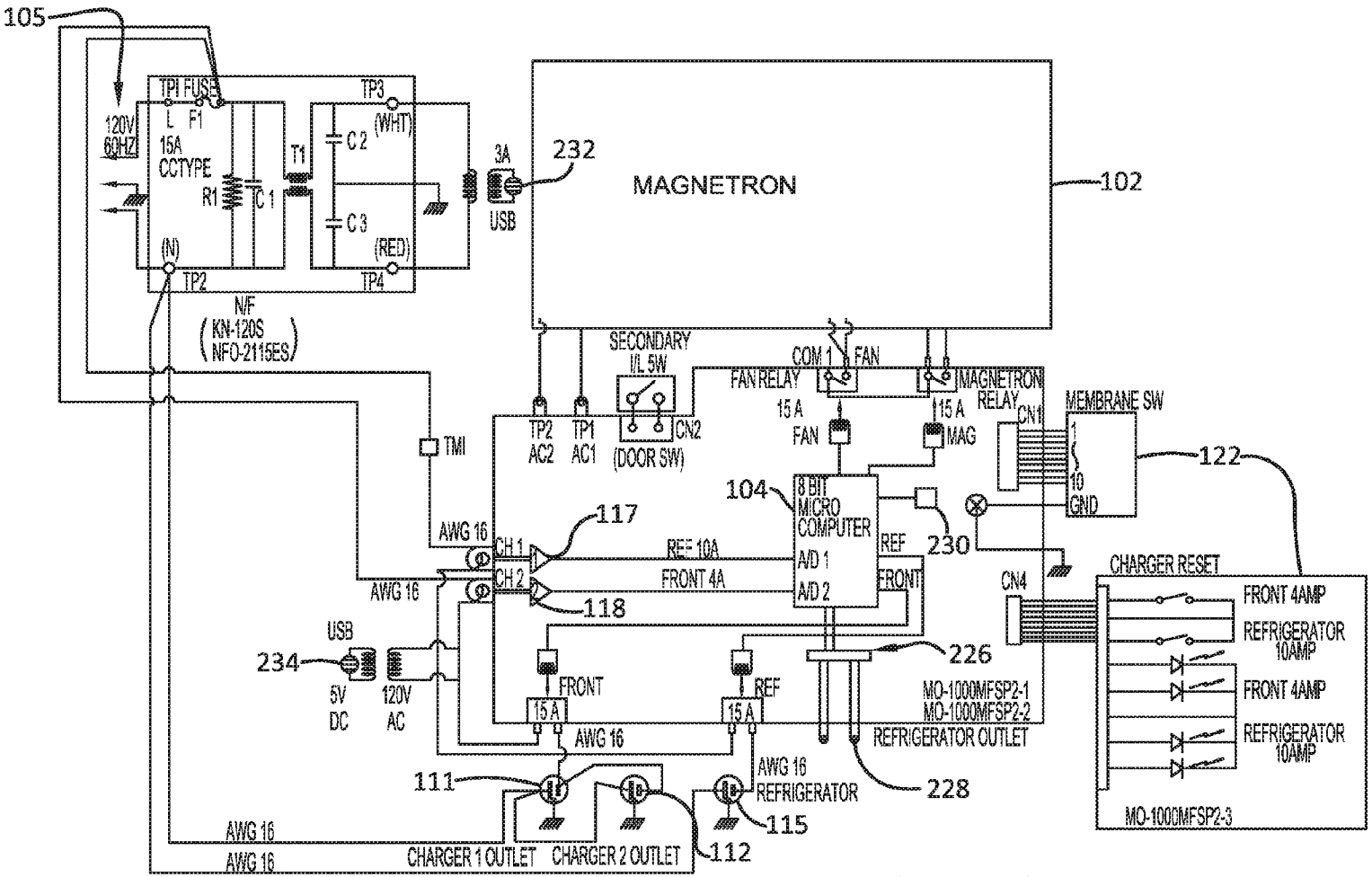
FIG. 16 is a schematic diagram of the embodiment of FIG. 15.
Figure 18:
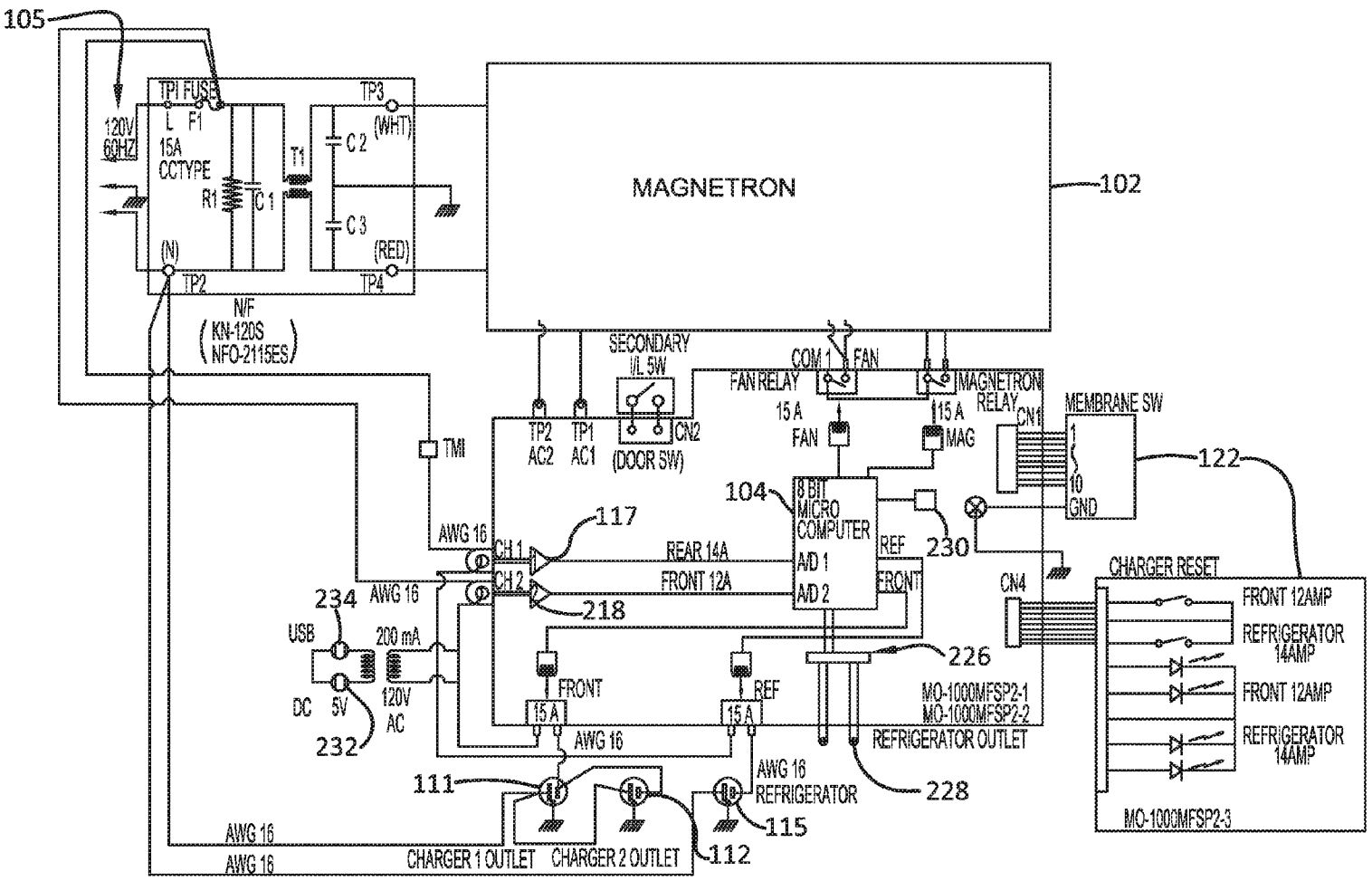
FIG. 18 is a schematic diagram of the embodiment of FIG. 17.
Figure 20:
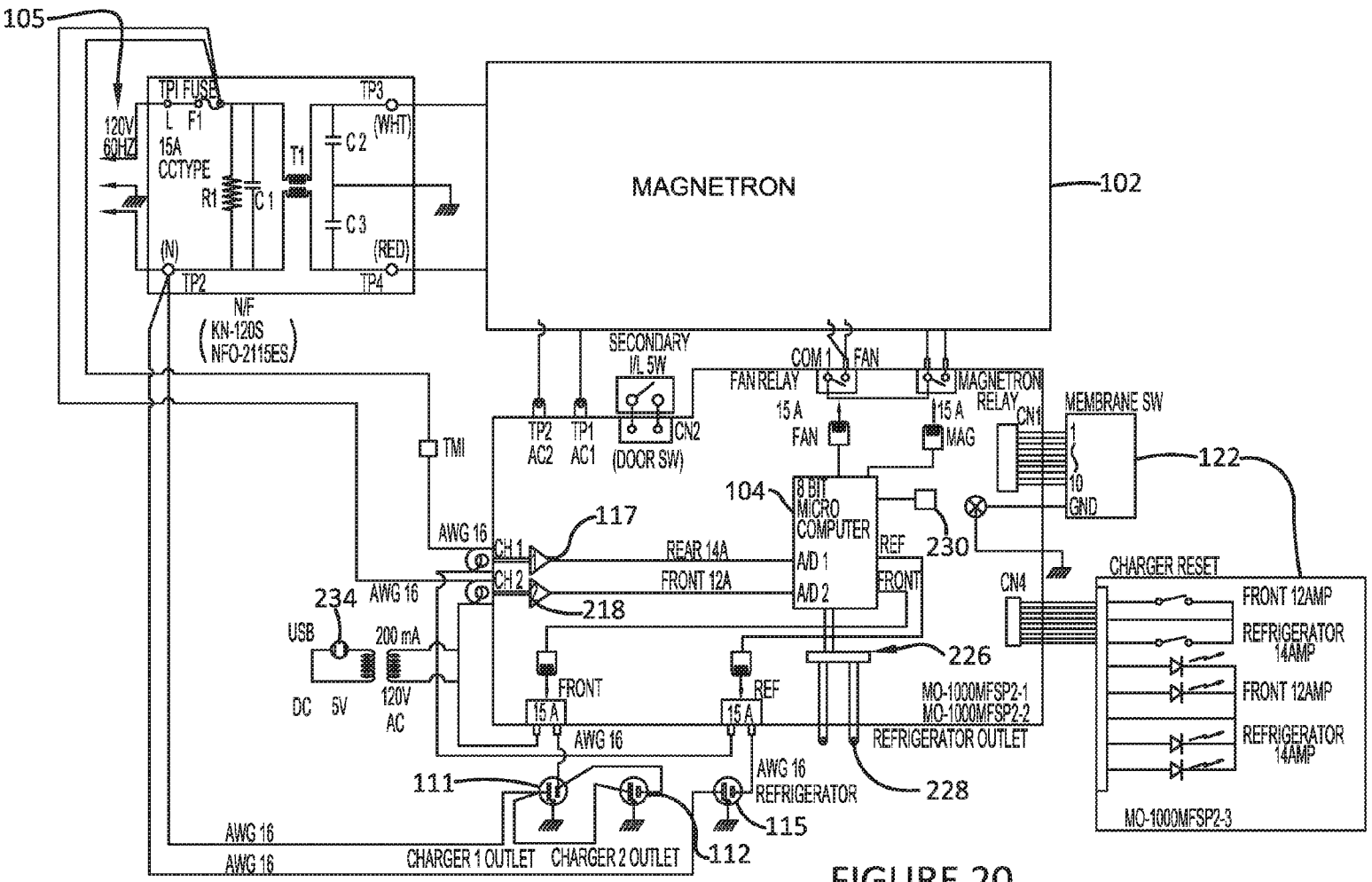
FIG. 20 is a schematic diagram of the embodiment of FIG. 19.

As seen in FIGS. 16, 18, and 20, a safety sensor which is alternatively referred to herein as a safety circuit 226 such as a smoke or gas sensor may be provided in the microwave oven 2. The smoke sensor 226 operates to turn off the microwave oven upon sensing smoke or polluted air indicative of a potentially dangerous condition such as excessive smoke generated from overcooked food. The safety sensor 226 may be powered on or otherwise operational when the microwave oven is in operation. The sensor includes programmed instructions and may implement logic flows and algorithms to determine the optimal activation point. The exemplary smoke sensor may be battery-powered or powered by house current through the control circuitry with an optional battery backup when the power from the house current is out. The smoke sensor may include an ionization smoke sensor that uses a radioisotope, typically Americium-241, to ionize air. The ionization smoke sensor operates to turn off the cooking function of the microwave oven upon sensing a difference due to smoke indicative of a potentially dangerous condition. The smoke sensor may include a radiation type smoke detector that may contain a source of infrared, visible, or ultraviolet light emitter (typically an incandescent light bulb or light-emitting diode), a lens, and a photoelectric or other type of radiation sensing receiver (typically a photodiode).

The sensor 226 may include an alcohol sensor that is coupled with a thermistor 228. An exemplary alcohol sensor 226 may operate in a temperature range. When heating is sensed by the thermistor 228, the thermistor 228 through suitable control circuitry causes the alcohol sensor 226 to turn on and become operational and check for properties of the gas within the interior area of the microwave.

If the alcohol sensor 226 senses polluted air that is indicative of a dangerous condition, a shutdown signal is outputted by the alcohol sensor to the controller 104. Upon receiving the shutdown signal, the controller 104 determines that the radiation emitting element of the microwave oven 2 should be shut down and causes the microwave to shutdown through the withdrawal of electrical power. If (after the alcohol sensor is caused to be turned on by the thermistor) the alcohol sensor 226 senses air that is not indicative of a dangerous condition such as the air produced by normal cooking of food in the microwave oven 2, the alcohol sensor circuitry will not send a shutdown signal to the controller 104.

Alternatively or in addition, a fault indicator 230 may be coupled to the microcontroller 104 or other circuitry to indicate that there is a dangerous condition upon detection by the alcohol sensor 226. For example, the fault indicator 230 may be a buzzer that is activated in response to the alcohol sensor 226 sensing polluted air indicative of a dangerous condition. In another example, fault indicator 230 may include the display 124 displaying a fault message such as "E-1" in response to the alcohol sensor 226 detecting polluted air indicative of a dangerous condition. Alternatively the fault indicator may output one or more signals, such as wireless alarm signals that can be detected by a receiver of an alarm system.

The exemplary embodiments may include a combination of fault indicators. For example, upon the alcohol sensor 226 sensing air that is indicative of a dangerous condition, a shutdown signal is outputted by the alcohol sensor 226 to the controller 104. Upon receiving the shutdown signal, the controller 104 determines that the microwave oven 2 should be shut down and causes the radiation element of microwave oven 2 to be shutdown by withdrawing electrical power therefrom. In addition in an exemplary embodiment, a buzzer is activated and the display 124 displays a fault message such as "E-1" in response to the alcohol sensor 226 sensing polluted air indicative of a dangerous condition.

The alcohol sensor 226 may be reset automatically responsive to the alcohol sensor 226 no longer detecting gas indicative of the dangerous condition. Alternatively or in addition, the alcohol sensor 226 may be reset upon a sensor sensing opening of the door 9 of the microwave oven 2. The display may display a "bar" or other suitable icon to indicate that the alcohol sensor 226 is turned on. Other types of suitable safety sensors may also be used instead of the alcohol sensor to detect a dangerous condition within the cooking area of the microwave.

In addition to a sensor which reacts to the gases generated from cooked food, the sensor 226 may use a temperature sensing capability such as, for example, using the thermistor 228 and related elements mentioned above.

Figure 24:
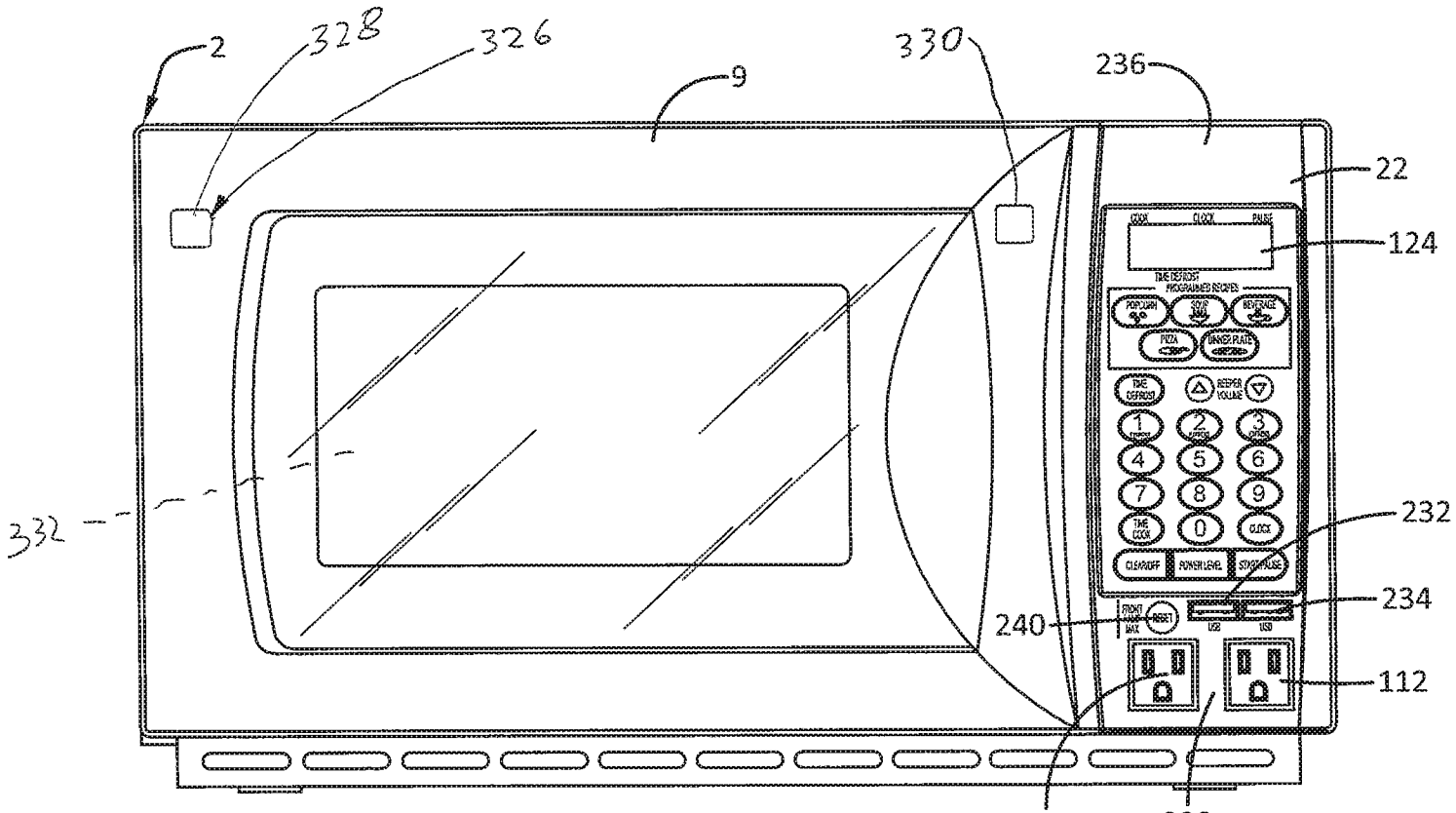
FIG. 24 is a front view of the microwave oven according to another embodiment.

Referring to FIG. 24, in another exemplary embodiment, the safety sensor which is alternatively referred to as a safety circuit may comprise an infrared sensor 326. The infrared sensor 326 may include two disposed infrared sensor elements in the form of a sensor emitter 328 and sensor receiver 330 (schematically shown in FIG. 24) provided on the microwave oven and located in the microwave's cavity 332. The exemplary infrared sensor 326 operates as follows. The sensor emitter 328 emits radiation and the sensor receiver 330 senses sensor radiation from the sensor emitter 328 while the microwave element operates during a cooking session. When smoke that is indicative of a dangerous condition passes in between the infrared sensor elements 328, 330, a determination is made by the safety circuit that a transmission amount of sensor radiation from the sensor emitter reaching the sensor receiver has fallen by at least a programmed threshold amount during the cooking session, due to smoke in the cooking interior area. Responsive to the determination, the cooking element of the microwave oven, is caused by the safety circuit to be no longer supplied with electrical power. The exemplary safety circuit may use the smoke point of oil or similar food products as the basis for its threshold amount, so that normal smoke emitted during the cooking or heating of food or beverages will not cause the infrared sensor 326 to deactivate cooking operation. The exemplary infrared sensor 326 would not require interaction from the microwave user. The exemplary safety sensor may be operative to cause an initial transmissivity level of sensor radiation that reaches the sensor receiver from the sensor emitter early in the cooking session to be stored in a memory associated with the safety circuit. The determination of a level of smoke corresponding to a dangerous condition is made in this embodiment responsive to the transmission amount of sensor radiation reaching the sensor receiver dropping by the threshold amount from the initial transmissivity level during the cooking session.

Figure 25:
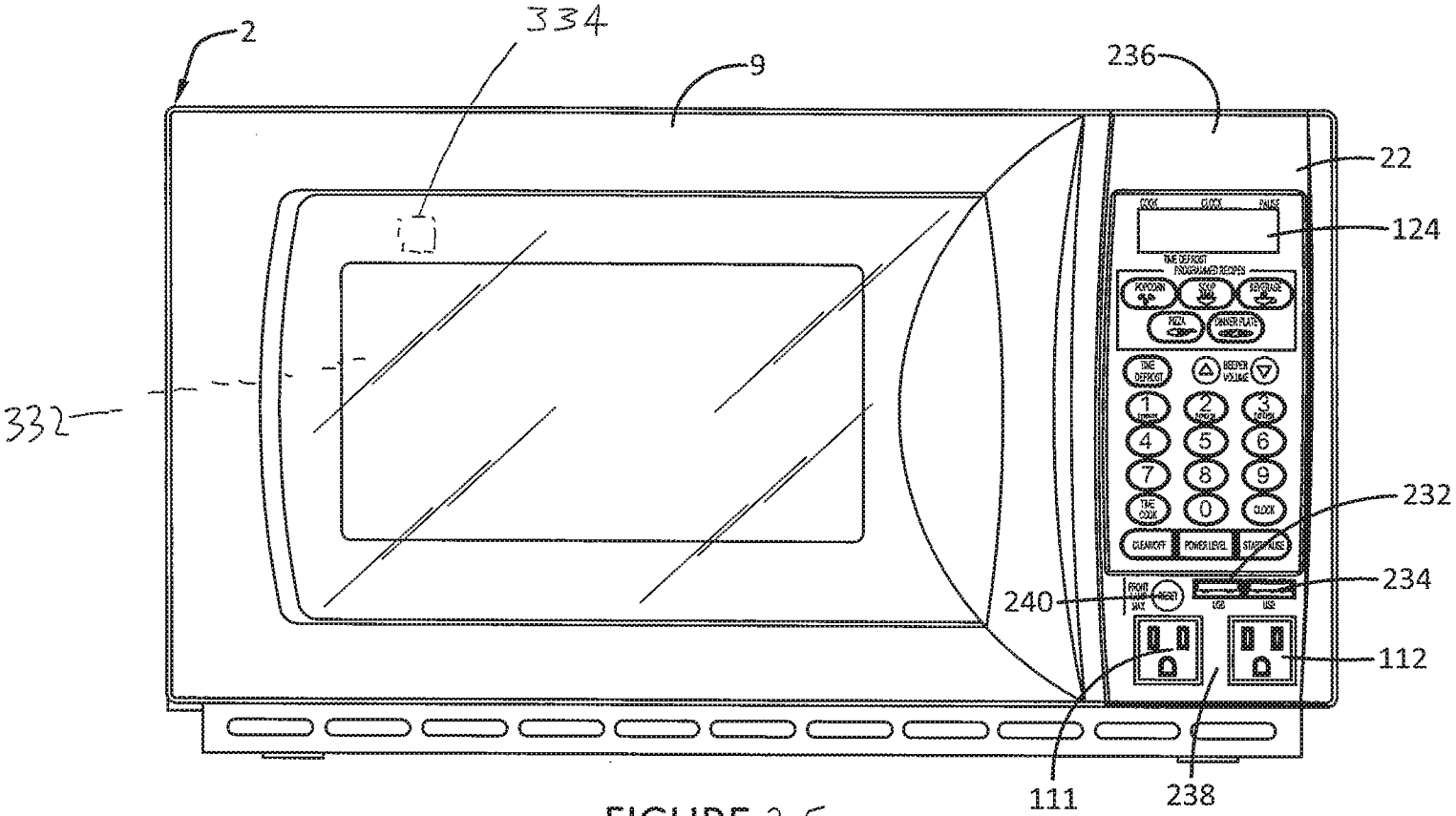
FIG. 25 is a front view of the microwave oven according to another embodiment.

Referring to FIG. 25, in another exemplary embodiment, the safety sensor or safety circuit may comprise a light sensor 334, which detects the increase smoke density within the microwave's cooking area which is alternatively referred to as a cavity. The light sensor 334 may also include a sensor emitter and sensor receiver. The light sensor 334 may be provided in the microwave cavity 332 and may operate as follows. At the beginning of a cooking cycle, all of the light generated travels through the clean air to the light sensor 334. As smoke increases in density, the amount of light that travels to the sensor receiver is reduced. The circuitry of light sensor 334 includes a programmed trip point or threshold that corresponds to the reduced amount of light sensed caused by the amount of smoke, that is indicative of a dangerous condition. When the trip point is reached, the safety circuit causes the electrical power to the radiation emitting element to be turned off. A determination would be made based on the amount of smoke that corresponds to the trip point and its corresponding light sensor reading.

Figure 26:
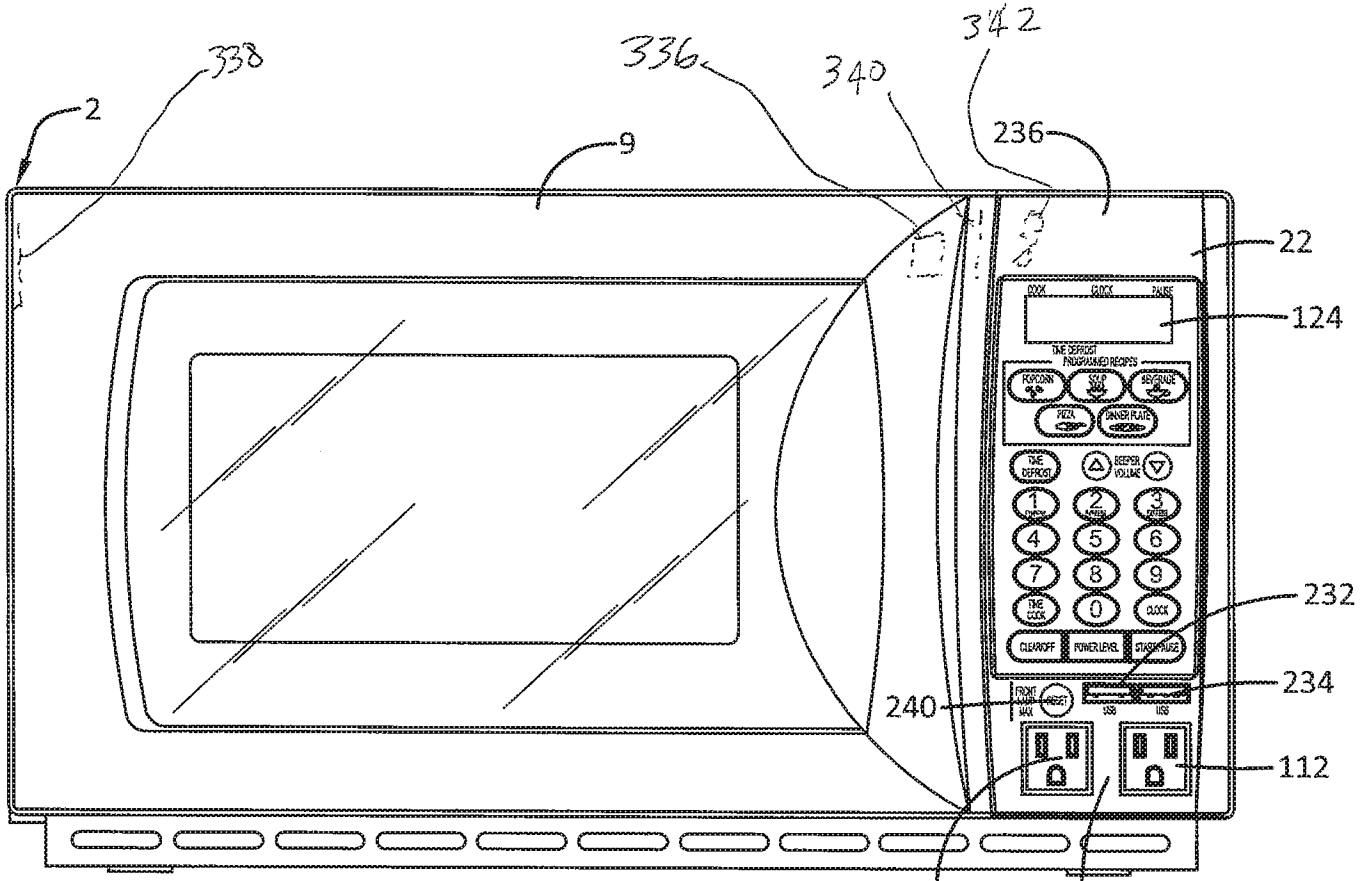
FIG. 26 is a front view of the microwave oven according to another embodiment of this application.

Referring to FIG. 26, in another exemplary embodiment, the safety sensor may include an optical motion sensor 336. The optical motion sensor 336 may also include a sensor emitter and sensor receiver. The optical motion sensor 336 may be positioned in the microwave cavity 332 at air exhaust vents 338, 340 of the microwave. The optical motion sensor 336 detects motion which is sensed due to the presence of smoke blown by an exhaust fan 342 of the microwave oven 2. The exhaust fan 342 is operative to cause air to move in an air passage connected to the microwave cavity. The sensor emitter and sensor receiver are operative to sense the transmission of radiation between the emitter and the receiver in the air passage. The optical motion sensor 336 has a trip point or threshold that corresponds to the presence of smoke of a predetermined density that corresponds to a reduced level of transmission that is indicative of a dangerous condition. When the trip point is reached, the optical motion sensor causes the cooking element of the microwave oven to be turned off. It should be noted that the exemplary optical motion sensor would not be positioned within the microwave cavity and directed toward a turntable therein, since the turntable itself may result in false alarms in some configurations.

Multiple sensors supported by control circuitry and associated algorithms may be used to determine the optimal point for removing electrical power from a microwave cooking element using sensed parameters that may include for example humidity, temperature rise and gas generated including combinations of absolute and relative values to analyze varied conditions. Other types of sensors may include flame sensors. Safety circuitry comprising flame sensors may detect and respond to the presence of a flame or fire. Upon the flame sensor detecting the presence of a flame, the flame sensor causes the cooking element of the microwave oven to turn off. The flame sensor may take the form of an optical flame sensor. The flame sensor may be of the type that utilizes ionization current flame detection. Alternatively, the flame sensor may be of the type that utilizes thermocouple flame detection.

Alternatively or in addition, the fault indicator 230 may be coupled to the controller 104 or other circuitry to indicate that there is a dangerous condition upon detection by any of the infrared sensor 326, light sensor 334, optical motion sensor 336, or flame or fire sensor in the embodiments described above. For example, the fault indicator 230 may be a buzzer that is activated in response to the safety sensor 226 sensing polluted air indicative of a dangerous condition. In another example, fault indicator 230 may include the display 124 displaying a fault message such as "E-1" in response to the safety sensor 226 detecting polluted air indicative of a dangerous condition.

Exemplary embodiments may include a combination of fault indicators. For example, upon the trip point or threshold value being reached by any of the infrared sensor 326, light sensor 334, or optical motion sensor 336, a shutdown signal is outputted by the sensor 226 to the controller 104. Upon receiving the shutdown signal, the controller 104 determines that the cooking element of the microwave oven 2 should be shut down and causes the microwave oven 2 to shutdown. In addition, a buzzer is activated and the display 124 displays a fault message such as "E-1" in response to the sensor 226 sensing polluted air indicative of a dangerous condition.

The smoke sensor, infrared sensor 326, light sensor 334, or optical motion sensor 336, may be reset automatically upon the sensor not detecting gas or other parameter indicative of the dangerous condition. Alternatively or in addition, the sensor may be reset upon circuitry sensing opening of the microwave door 9 of the microwave oven 2. The display may display a "bar" or other suitable icon to indicate that the sensor is turned on. Numerous types of suitable safety sensors may also be used instead of the alcohol sensor to detect a dangerous condition.

Figure 15:
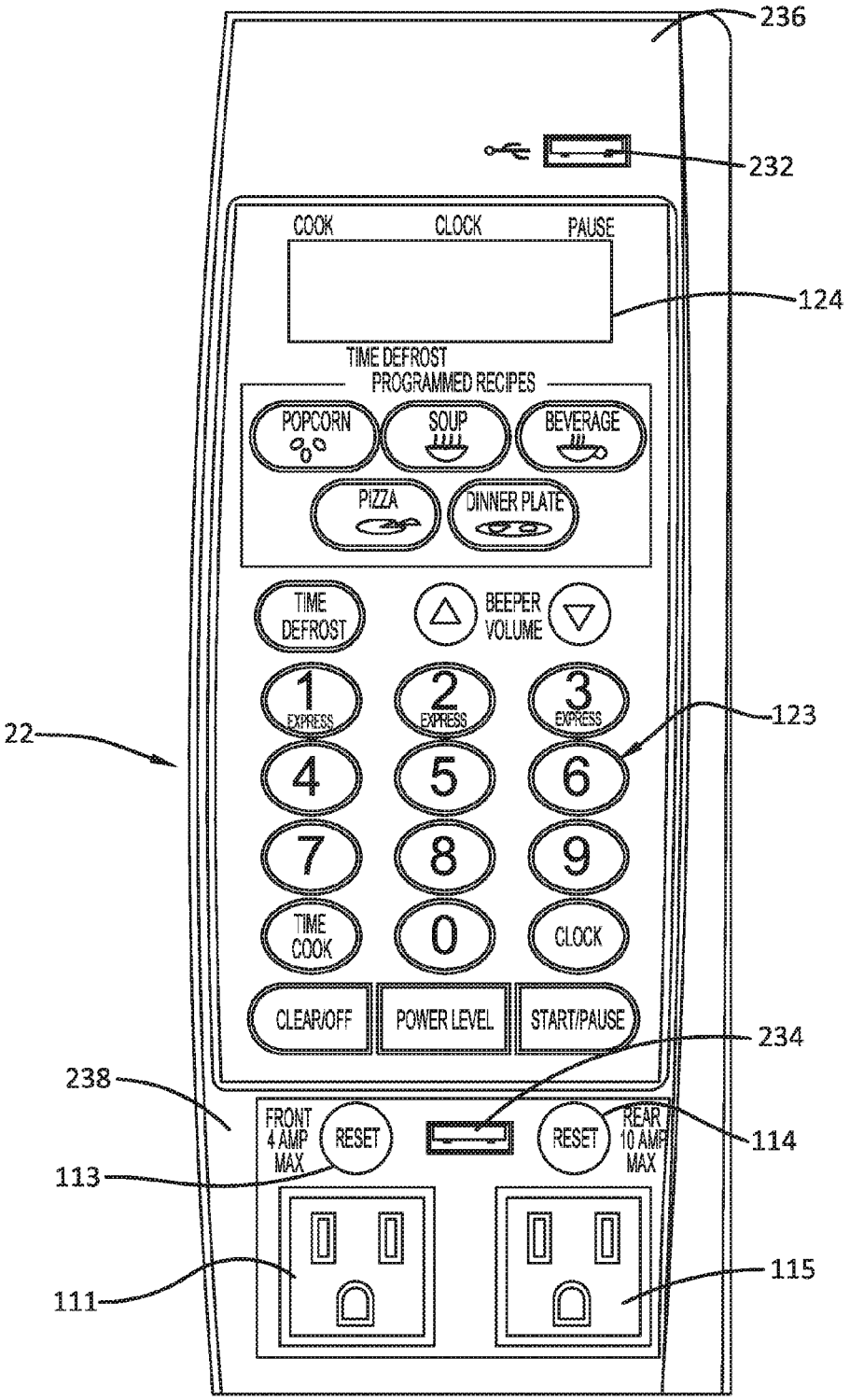
FIG. 15 is an illustration of a control panel of an alternate embodiment.
Figure 27:
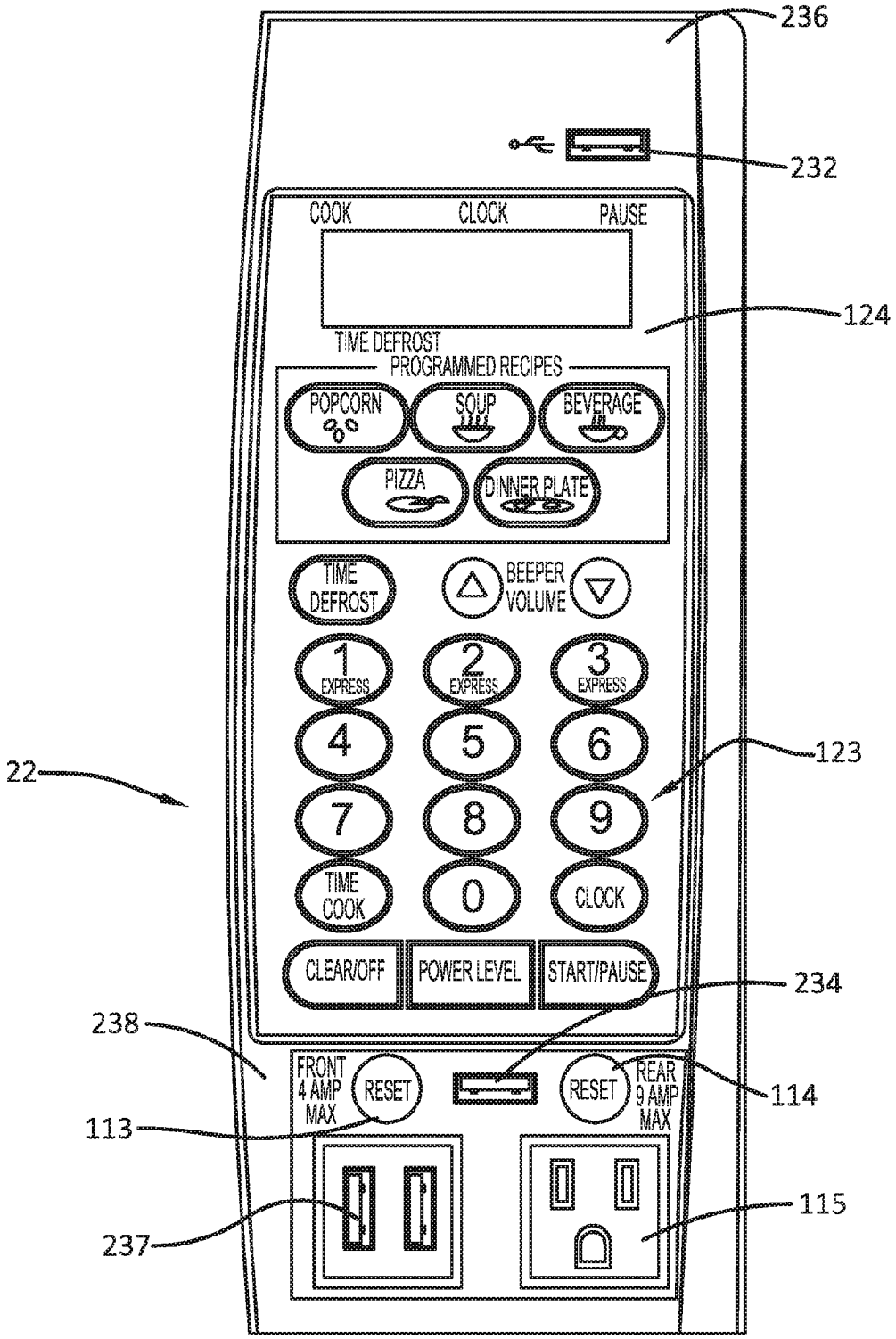
FIG. 27 is an illustration of a control panel of an alternate embodiment.

As shown in FIGS. 15, 16 and 27, the front control panel 22 of the microwave oven 2 may include Universal Serial Bus (USB) ports 232, 234 for connection, communication, and power supply between the front control panel 22 and electronic devices such as a personal computer, cell phone, Ipod®, Ipad®, or other suitable device to allow communication and/or charging of the electronic device plugged into the USB ports. In one exemplary embodiment, a first USB port 232 may be provided on the upper portion 236 of the front control panel 22, and a second USB port 234 may be provided on the lower portion 238 of the front control panel 22 above the auxiliary outlets 111, 112 and between the reset buttons 113, 114 as seen in FIG. 15. The first USB port 232 may be operatively connected to a three ampere fuse and a linear time-variant system (LVT) of 100 mA, 120 volts, and 12 watts. The second USB port 234 may be operatively connected to a linear time-variant system (LVT) of 200 mA, 120 volts, and 24 watts. The second USB port 234 may also be reset. The current sensor 118 may be constructed to limit the second USB port and the two auxiliary outlets to 12 amps. The USB ports 232, 234 may be in operative connection with respective printed circuit boards. Alternatively, as represented in FIG. 27, instead of auxiliary outlet 111, another USB port 237 may be provided on the front panel 22 at the location of the auxiliary outlet 111. Alternatively or in addition, one or more USB ports may be provided on the rear of the microwave oven, the sides of the microwave oven, and/or the top or bottom of the microwave oven. Alternatively or in addition, one or more auxiliary outlets may be provided on the rear of the microwave oven, the sides of the microwave oven, and/or the top or bottom of the microwave oven. Alternatively, the refrigerator outlet may be provided on the top, bottom, or one of the sides of the microwave oven.

Figure 17:
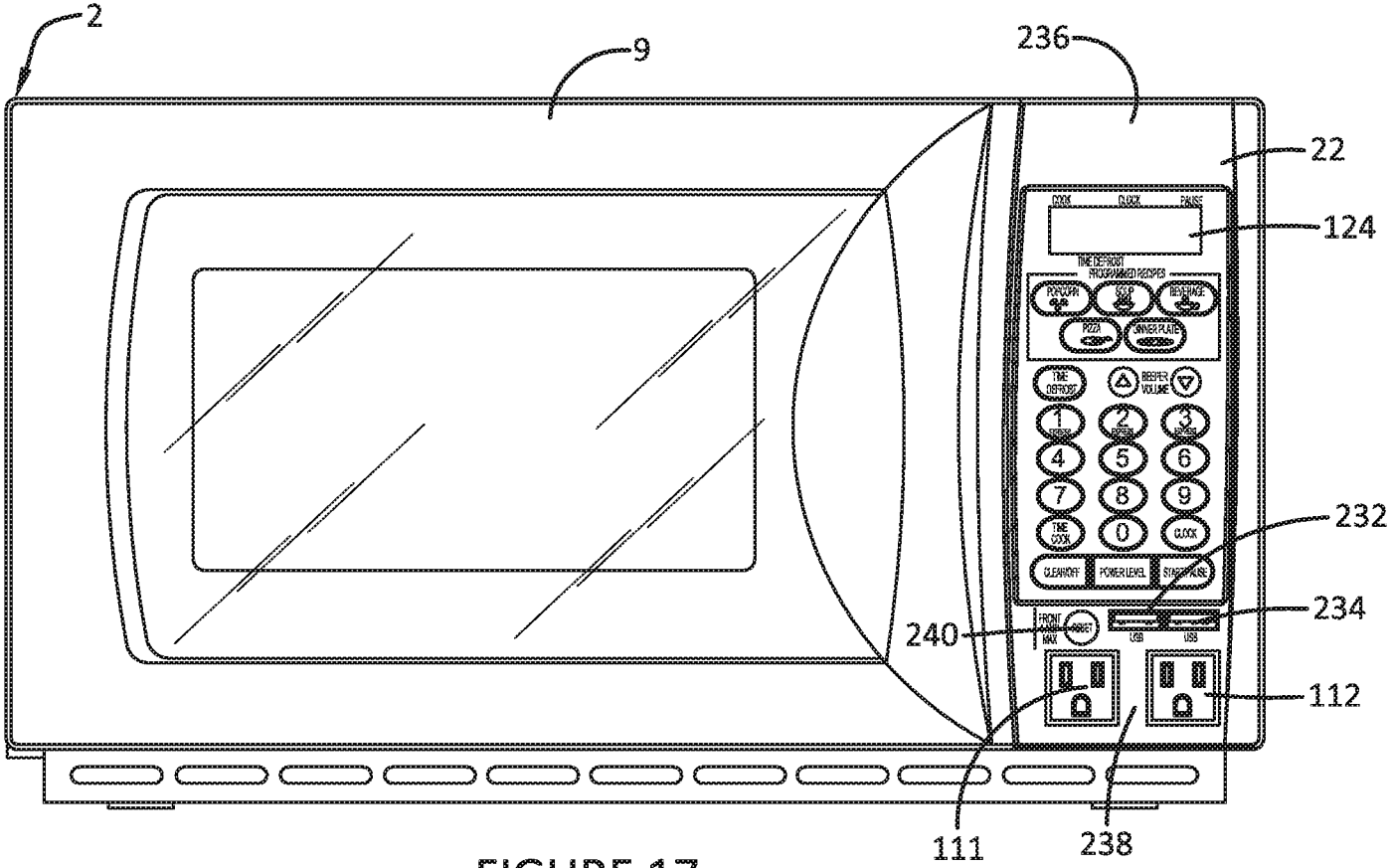
FIG. 17 is a front view of the microwave oven according to another embodiment.

FIGS. 17 and 18 show another exemplary arrangement of the USB ports 232, 234. In this arrangement, the first and second USB ports 232, 234 are located side by side on the lower portion 238 of the front control panel 22 above the auxiliary outlets 111, 112. The USB ports 232, 234 are also located rightwardly (as viewed in FIG. 17) adjacent a status LED indicator and reset button 240. In this exemplary arrangement, current sensor 218 is connected to monitor the combined current in the USB ports 232, 234 and the auxiliary outlets 111 and 112. The current sensor 218 is constructed to limit the combined current in the USB ports and auxiliary outlets 111 and 112 to 12 amperes. The LED indicator and reset button 240 may illuminate when power to the auxiliary outlets 111, 112 and the USB ports 232, 234 is available and flash when disabled. In another embodiment, the LED indicator and reset button 240 may be off when power to the auxiliary outlets 111, 112 and the USB ports 232, 234 is available and illuminate or flash when disabled. In an exemplary arrangement, depressing the LED indicator and reset button 240 enables the auxiliary outlets 111, 112 and the USB ports 232, 234 so that power may be supplied to them when the combined current in them falls from above to below the limit.

Figure 19:
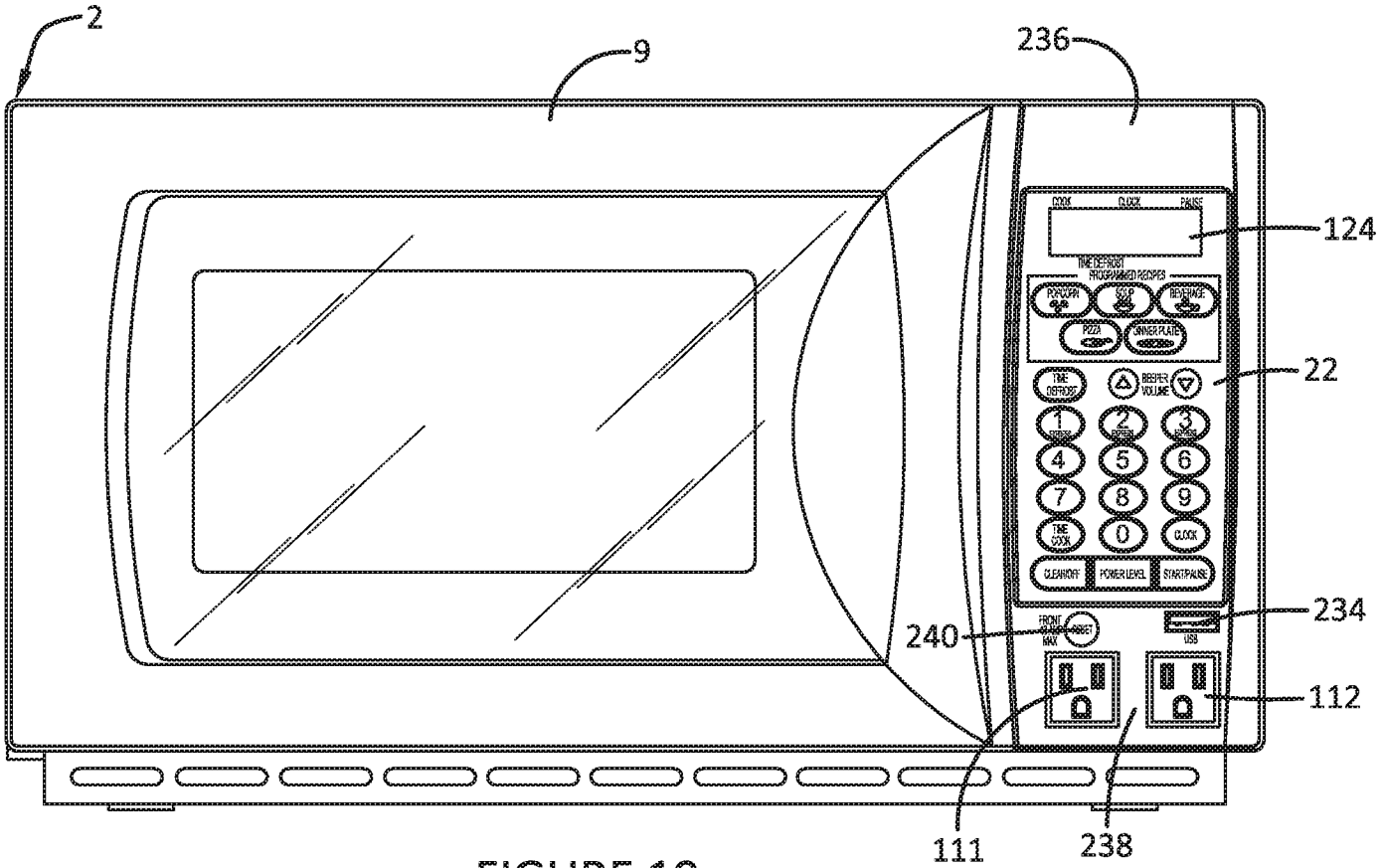
FIG. 19 is a front view of the microwave oven according to another embodiment.

FIGS. 19 and 20 show an alternative arrangement in which one USB port 234 is located above the auxiliary outlets 111, 112 and rightwardly adjacent the status LED indicator and reset button 240. In this exemplary arrangement, the current sensor 218 is connected to monitor the combined current in the USB port 234 and auxiliary outlets 111 and 112. The current sensor 218 is constructed to limit the combined current in the USB port 234 and auxiliary outlets 111 and 112 to 12 amperes. Alternatively, the current sensor 218 may be constructed to limit the combined current in the USB port 234 and the auxiliary outlets 111 and 112 to 13 amperes. The LED indicator and reset button 240 may illuminate when power to the auxiliary outlets 111, 112 and the USB port 234 is available and flash when disabled. In another embodiment, the LED indicator and reset button 240 may be off when power to the auxiliary outlets 111, 112 and the USB port 234 is available and illuminate or flash when disabled. In an exemplary arrangement, depressing the LED indicator and reset button 240 enables the auxiliary outlets 111, 112 and the USB port 234 so that power may be supplied to them when the combined current in them falls from above to below the limit. Other elements of the embodiments of FIGS. 17-20 may be similar in structure and function as the embodiment shown in FIGS. 1-11. Thus, the same reference numbers may be used to indicate elements that are similar to those in the embodiments shown in FIGS. 1-11.

Figure 21:
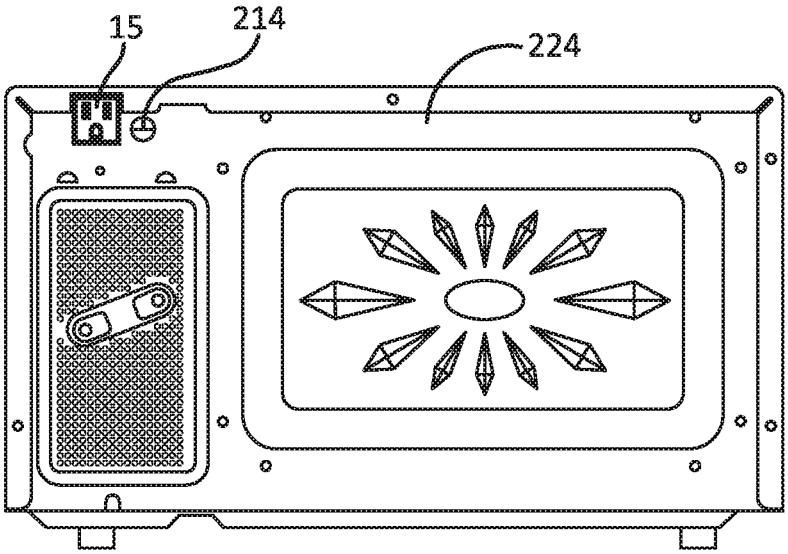
FIG. 21 is a rear view of the microwave oven according the embodiments of FIGS. 12-19.
Figure 22:
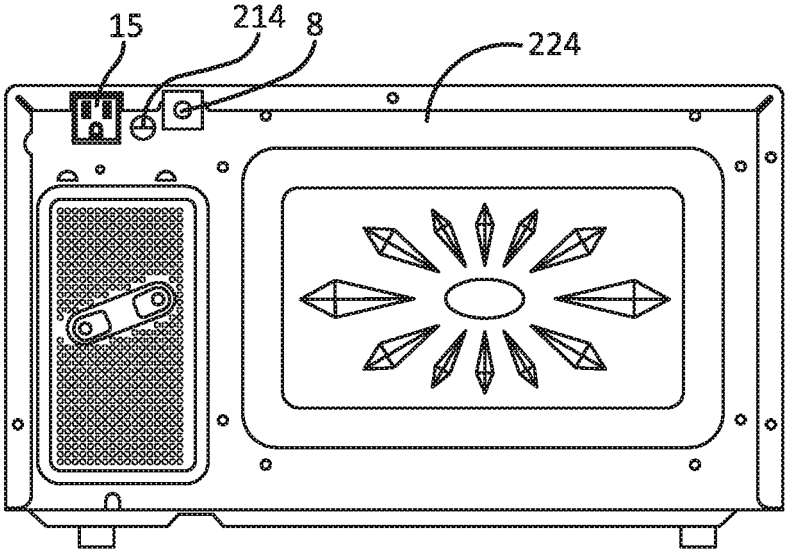
FIG. 22 is a similar view as that of FIG. 21 except that the AC cord is shown.

FIG. 21 shows the rear portion 244 of the microwave oven for the embodiments shown in FIGS. 12-20. Refrigerator outlet 15 is shown to be provided on and accessible from the rear portion 244 of the microwave oven and is associated with the LED indicator and reset button 214, which is also provided on the rear portion 244 of the microwave oven. FIG. 22 is a similar view as FIG. 21 except that AC cord 8 for the microwave oven is shown.

In the embodiments shown in FIGS. 12-22, logic flow control models may be established for execution by the controller which is also referred to as at least one control circuit 4. These models can be in the form of processor executable instructions stored in a computer readable medium, such as software or firmware within the control circuit 104. The models or scenarios are, in the first instance, dependent on the state of operation of the microwave oven 2. The current demands of the microwave oven 2 are generally the most significant contribution to overload. To avoid overload conditions, power to the low power receptacles or auxiliary outlets, refrigerator receptacle, and/or USB ports is disabled during microwave operation.

Figure 23:
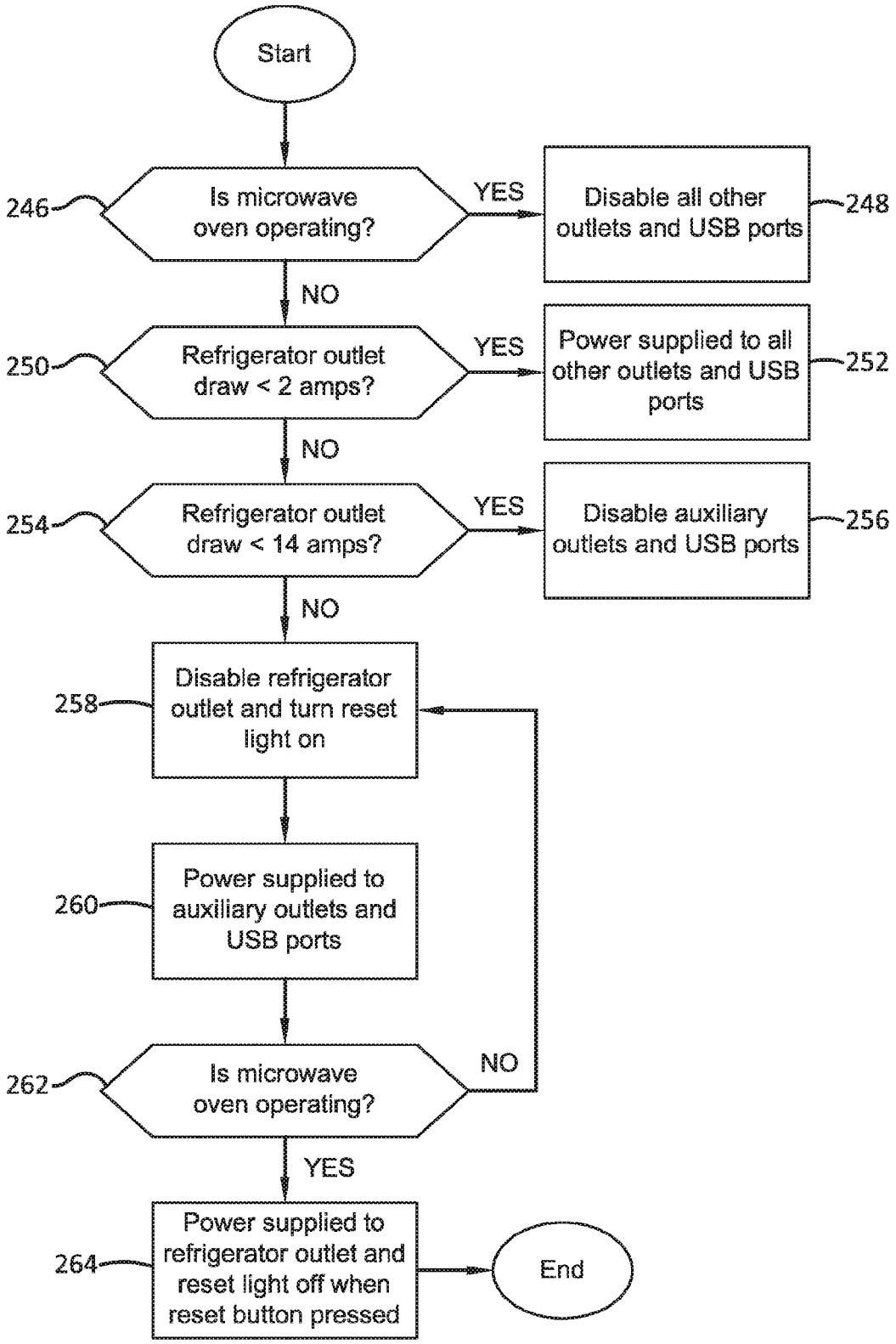
FIG. 23 is a logic flow diagram of an embodiment.

FIG. 23 shows a flow chart illustrating several control models or scenarios. The control circuit 104 begins by determining whether the microwave oven is turned on or operating to perform cooling in step 246. When the microwave oven is turned on and operating to perform cooking, the rear refrigerator outlet 15, the two auxiliary outlets 111, 112 on the front control panel 22, and the two USB ports 232, 234 on the front control panel are all turned off or disabled, so that the total draw of current for the combination microwave and refrigerator is not over 15 amperes as indicated in step 248.

When the microwave oven is not drawing cooking power and items are plugged into the two USB ports 232, 234, two auxiliary outlets 111, 112, and rear refrigerator outlet 15, then the control circuit 104 determines whether the refrigerator outlet 15 is drawing less than 2 amperes (approximately the average amperes when the refrigerator compressor is running) in step 250. If the refrigerator outlet 15 is drawing less than 2 amperes, then all the outlets 15, 111, 112 and USB ports 232, 234 are caused to be enabled, so that power may be supplied through them as indicated in step 252. If the refrigerator outlet 15 not drawing less than 2 amperes, the control circuit 104 determines whether the refrigerator outlet 15 is drawing less than 14 amperes in step 254. If the refrigerator outlet 15 is drawing less than 14 amperes but not less than or greater than or equal to 2 amperes, then the auxiliary outlets 111, 112 and USB ports 232, 234 are disabled or turned off so that no power may be supplied to them as indicated in step 256. The refrigerator outlet 15 remains enabled. If the refrigerator outlet 15 is not drawing less than 14 amperes or drawing greater than or equal to 14 amperes, then the refrigerator outlet 15 is disabled in step 258. This may be accomplished by tripping the relay 20 of the reset circuit off. In addition, the red LED light on the LED indicator and reset button 214 is turned on to identify the disabled condition of the refrigerator. Then, in step 260, the auxiliary outlets 111, 112 and USB ports 232, 234 are enabled so that power may be supplied through them.

Then, the control circuit determines whether the refrigerator outlet 15 is drawing less than 14 amperes in step 262. If the refrigerator outlet 15 is not drawing less than 14 amperes or drawing greater than or equal to 14 amperes, then the refrigerator outlet 15 remains disabled and the red LED light on the LED indicator and reset button 214 remains turned on to identify the disabled condition of the refrigerator 3. This condition may occur, for example, if an electrical heater is plugged into the refrigerator outlet 15. When the refrigerator outlet 15 draws less than 14 amperes resulting from the overload condition being eliminated, the refrigerator outlet 15 will be enabled by the control circuit so that power may supplied to the refrigerator outlet 15 upon the LED indicator and reset button 214 being depressed as indicated in step 264. Depression of the LED indicator and reset button 214 in this condition will also turn off the red LED light. The process then ends. It should be noted that the at least one control circuit 104 can make the determination in steps at the same time or in a different order.

Although exemplary embodiments are described herein as used in conjunction with vapor compression refrigerators, embodiments employing the principles described herein may also be used with other types of refrigerators. Such refrigerators may include refrigerators that use thermoelectric cooling, such as Peltier elements to provide cooling. Other embodiments may include absorption refrigerators to provide cooling. In such embodiments the components of the refrigerator apparatus which draw electrical power, are controlled through operation of at least one control circuit, to prevent, suspend or defer the operation thereof at times when the microwave radiation emitting element of other components that draw electrical power are to be operated, so as to avoid exceeding a maximum threshold for current draw for the combined appliance that is permitted by the at least one control circuit.

It should be understood that the above description is only illustrative of the exemplary embodiments. Various alternatives and modifications can be devised by those skilled in the art without departing from the exemplary embodiments. Accordingly, the present application is intended to embrace all such alternatives, modifications and variances which fall with the scope of the appended claims.

What is claimed is:

1. Apparatus comprising:

a microwave oven, wherein the microwave oven includes:

a radiation emitting microwave element, a microwave housing, wherein the microwave housing bounds a cooking interior area, wherein the radiation emitting microwave element is operative to irradiate the cooking interior area, at least one power control circuit, wherein the at least one power control circuit is operative to cause electrical power to be selectively delivered to the microwave element, wherein the microwave oven further includes at least one sensor emitter and at least one sensor receiver configured to receive radiation from the at least one sensor emitter, wherein air of at least a portion of the cooking interior area extends intermediate of the at least one sensor emitter and the at least one sensor receiver, at least one sensor circuit, wherein the at least one sensor circuit is in operative connection with the at least one sensor emitter, the at least one sensor receiver, and the microwave element, wherein the at least one sensor circuit is operative to cause the at least one sensor emitter to emit sensor radiation and the at least one sensor receiver to sense sensor radiation from the at least one sensor emitter while the microwave element operates during a current cooking session, data to be stored in a memory associated with the at least one sensor circuit corresponding to an initial transmissivity level of transmitted radiation from the at least one sensor emitter that reaches the at least one sensor receiver early in the current cooking session, comparison of a current level of transmitted radiation during the current cooking session and the initial transmissivity level, a determination based on the stored data that the current level of transmitted radiation from the at least one sensor emitter that reaches the at least one sensor receiver has fallen by at least a threshold amount from the initial transmissivity level during the current cooking session, due to smoke in the cooking interior area, responsive at least in part to the determination, the microwave element to no longer be supplied with electrical power to prematurely end the current cooking session, wherein the at least one sensor circuit is configured to reset after the premature end of the current cooking session responsive to the at least one sensor circuit, so that the at least one sensor circuit is operative to cause the radiation emitting microwave element to be allowed to be supplied with electrical power during a next subsequent cooking session.

2. The apparatus according to claim 1 wherein the microwave oven housing includes a fan, and at least one air passage, wherein the at least one air passage is in connection with the cooking interior area, wherein the fan is operative to cause air to move in at least one air passage, wherein the at least one sensor emitter and the at least one sensor receiver are operative to sense the transmission amount in the at least one air passage.

3. The apparatus according to claim 1 further including a power supply outlet, wherein the power supply outlet is provided on the microwave oven, wherein the power supply outlet is configured to receive an electrical connection to an appliance having lower power requirements than power requirements of the microwave oven, wherein the at least one power control circuit is operative to cause electrical power to be selectively delivered to the microwave element, and the power supply outlet, wherein the power supply outlet does not operate when the microwave element operates.

4. The apparatus according to claim 1 and further comprising:

a power supply outlet provided on the microwave oven, wherein the power supply outlet is in operative connection with the at least one power control circuit, a refrigerator configured to be connected to the power supply outlet, wherein the refrigerator includes a refrigerator housing, wherein the refrigerator housing bounds a cooled refrigerator interior area, wherein the refrigerator housing is in fixed operative connection with the microwave housing, wherein the refrigerator includes a refrigerant compressor, wherein the refrigerant compressor is operative to compress refrigerant material, wherein the refrigerant is operative to cause cooling of the cooled refrigerator interior area, wherein the at least one power control circuit is configured to:

disable refrigerator operation by not supplying electrical power to the compressor thereof, when the microwave element draws cooking power;

enable refrigerator operation by supplying electrical power to the compressor when the microwave element does not draw cooking power.

5. The apparatus according to claim 4, and further including a remote control, wherein the remote control is configured to control at least one operation of the refrigerator or the microwave oven, or an operation of each of the refrigerator and the microwave oven.

6. The apparatus according to claim 5, wherein the remote control comprises a mobile phone.

7. The apparatus according to claim 4, and further comprising at least one Universal Serial Bus (USB) port, wherein the at least one USB port is positioned on at least one of the refrigerator and the microwave oven.

8. The apparatus according to claim 4 and further including a temperature sensor in the cooking interior area, wherein the temperature sensor is in operative connection with the at least one sensor, and wherein the at least one power control circuit is operative to cause the microwave element to no longer be supplied with cooking power to prematurely end the current cooking session responsive to the determination and the temperature being sensed above a temperature level during the current cooking session.

9. An apparatus comprising:

a microwave oven configured to be connected to a source of electrical power and having a control circuit, wherein the control circuit is configured to control operation of the microwave oven;

a smoke sensor, wherein the smoke sensor is positioned in the microwave oven, and is in operative connection with the control circuit, wherein the smoke sensor is configured to cause cooking power to the microwave oven to be withdrawn prior to a set end time of a current cooking session upon the smoke sensor sensing smoke indicative of a dangerous condition; and wherein the smoke sensor is configured to be reset after ending the current cooking session prior to the set end time based on sensing the smoke indicative of the dangerous condition, to enable the microwave oven to deliver cooking power in a next subsequent cooking session responsive at least in part to the smoke sensor no longer sensing the smoke indicative of the dangerous condition.

10. The apparatus according to claim 9 and further comprising:

a power supply outlet on the microwave oven, wherein the power supply outlet is in operative connection with the control circuit, a refrigerator, wherein the refrigerator is electrically connected with the power supply outlet, wherein the control circuit is operative to withdraw electrical power from the refrigerator when the microwave oven draws cooking power, deliver electrical power to the refrigerator when the microwave oven does not draw cooking power.

11. Apparatus comprising:

a microwave oven configured to be connected to a source of electrical power and having a control circuit configured to control operation of the microwave oven, wherein the microwave oven includes an interior area, a smoke sensor, wherein the smoke sensor is positioned in the interior area, wherein the smoke sensor is in operative connection with the control circuit, wherein the smoke sensor is configured to cause cooking power to be withdrawn from the microwave oven prior to a set end time of a current cooking session responsive at least in part to the smoke sensor sensing at least one change in an amount of smoke sensed by the smoke sensor which at least one change corresponds to a dangerous condition, and wherein the control circuit is configured to reset after ending the current cooking session prior to the set end time due to sensing the dangerous condition, to enable cooking power to again be available to the microwave oven in a next subsequent cooking session responsive at least in part to the smoke sensor no longer sensing the dangerous condition.

12. The apparatus according to claim 11 and further comprising:

a power supply outlet on the microwave oven, a refrigerator configured to be connected to the source of electrical power by connection to the power supply outlet, wherein the refrigerator includes a compressor, wherein the control circuit is operative to cause electrical power to be unavailable to the compressor, when the microwave oven demands cooking power, electrical power to be available to the compressor when the microwave oven does not demand cooking power.

* * * * *